US012264024B2

(12) United States Patent
Okada

(10) Patent No.: US 12,264,024 B2
(45) Date of Patent: Apr. 1, 2025

(54) SHEET FEEDING DEVICE AND IMAGE FORMING APPARATUS INCORPORATING SAME

(71) Applicant: Katsumi Okada, Kanagawa (JP)

(72) Inventor: Katsumi Okada, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 102 days.

(21) Appl. No.: 18/086,699

(22) Filed: Dec. 22, 2022

(65) Prior Publication Data

US 2023/0264912 A1 Aug. 24, 2023

(30) Foreign Application Priority Data

Feb. 18, 2022 (JP) ..... 2022-023941

(51) Int. Cl.
*B65H 26/00* (2006.01)
*B65H 19/10* (2006.01)

(52) U.S. Cl.
CPC ..... *B65H 19/105* (2013.01); *B65H 2553/80* (2013.01); *B65H 2701/1311* (2013.01)

(58) Field of Classification Search
CPC ..... B65H 26/00; B65H 2553/80; B65H 2553/81; B65H 2701/1311; B65H 2301/41342; B65H 2301/41387; B65H 2301/522; B65H 2403/942; B65H 19/105; B65H 23/005
USPC ..... 242/600, 615.21
See application file for complete search history.

(56) References Cited

U.S. PATENT DOCUMENTS

| | | | | |
|---|---|---|---|---|
| 8,857,976 | B2 * | 10/2014 | Nakada | B41J 15/02 347/104 |
| 9,457,596 | B2 * | 10/2016 | Ogawa | B41J 11/0075 |
| 9,567,176 | B2 * | 2/2017 | Mizutani | B65H 26/063 |
| 10,421,299 | B2 * | 9/2019 | Daikoku | B41J 11/0095 |
| 10,427,431 | B2 * | 10/2019 | Masuda | B41J 15/04 |
| 11,273,654 | B2 * | 3/2022 | Eiyama | B41J 15/046 |
| 11,613,137 | B2 * | 3/2023 | Okada | B41J 11/0095 347/104 |
| 11,806,995 | B2 * | 11/2023 | Eiyama | B65H 16/021 |
| 11,878,886 | B2 * | 1/2024 | Okada | G03G 15/6502 |
| 2021/0370693 | A1 | 12/2021 | Okada et al. | |

(Continued)

FOREIGN PATENT DOCUMENTS

| | | |
|---|---|---|
| JP | 2004-067327 | 3/2004 |
| JP | 2018-150107 | 9/2018 |
| JP | 2021-113118 | 8/2021 |

*Primary Examiner* — Leslie A Nicholson, III
(74) *Attorney, Agent, or Firm* — XSENSUS LLP

(57) ABSTRACT

A sheet feeding device includes a sensor, a roller, a support, circuitry, and a spool. The sensor detects a step at a leading end of a sheet roll. The roller and the sensor are disposed at different positions in a circumferential direction of the sheet roll. The support supports the sensor and the roller to bring the sensor and the roller into contact with the sheet roll. The circuitry acquires a sensor signal. The spool is insertable through a sheet tube of the sheet roll to rotate the sheet roll. The sensor and the roller face an axial center of the spool. The support is pivotable within a range in which the sensor does not contact the spool. The circuitry detects first and second inclinations of the sensor signal when the leading end passes by the roller and the sensor, respectively, to determine whether the leading end is present.

12 Claims, 25 Drawing Sheets

(56) References Cited

U.S. PATENT DOCUMENTS

| | | | |
|---|---|---|---|
| 2021/0371227 | A1 | 12/2021 | Okada et al. |
| 2022/0363504 | A1 | 11/2022 | Okada |

* cited by examiner

FIG. 21

| SYMBOL | MEANING |
|---|---|
| N | NUMBER OF TIMES OF LEADING-END DETECTING OPERATION |
| K1 | INCLINATION OF SENSOR SIGNAL WHEN LEADING END OF SHEET IS SEPARATED FROM ROLLER |
| K2 | INCLINATION OF SENSOR SIGNAL WHEN LEADING END OF SHEET IS SEPARATED FROM SENSOR |
| T1 | RANGE OF TIME IN WHICH K2 IS SUPPOSED TO BE DETECTED AFTER DETECTION OF K1<br>T1 IS PREFERABLY EQUAL TO CIRCUMFERENTIAL DISTANCE (mm)<br>FROM ROLLER TO SENSOR ÷ VELOCITY (mm/s) LEADING END OF SHEET + MARGIN TIME |
| T2 | RANGE OF TIME IN WHICH K1 (K2) IS SUPPOSED TO BE DETECTED AGAIN AFTER DETECTION OF K1 (K2)<br>AND ONE ROTATION OF SHEET ROLL + MARGIN TIME |
| R | VALUE ASSIGNED TO INDICATE NUMBER OF ROTATIONS OF SHEET ROLL UNTIL LEADING END IS DETECTED |
| a | NUMBER OF TIMES OF LEADING-END DETECTING OPERATION<br>SET TO ENHANCE RELIABILITY BY MULTIPLE TIMES OF DETECTING OPERATION |
| S | VALUE ASSIGNED TO INDICATE NUMBER OF ROTATIONS OF SHEET ROLL TO DETERMINE<br>WHETHER SPOOL IS SET ALONE OR SENSOR IS OUT OF ORDER |
| NS | VALUE ASSIGNED TO INDICATE NUMBER OF TIMES OF DETERMINATION AS TO WHETHER<br>SENSOR IS OUT OF ORDER BY COUNTING NUMBER OF TIMES OF OPERATION WITHOUT SENSOR OUTPUT |

SHEET FEEDING DEVICE AND IMAGE FORMING APPARATUS INCORPORATING SAME

CROSS-REFERENCE TO RELATED APPLICATION

This patent application is based on and claims priority pursuant to 35 U.S.C. § 119(a) to Japanese Patent Application No. 2022-023941, filed on Feb. 18, 2022, in the Japan Patent Office, the entire disclosure of which is hereby incorporated by reference herein.

BACKGROUND

Technical Field

Embodiments of the present disclosure generally relate to a sheet feeding device and an image forming apparatus incorporating the sheet feeding device.

Related Art

Image forming apparatuses for which a sheet roll is used are known in the art that includes a sheet feeding device that performs a sheet feeding operation after the sheet roll is set on a spool and placed on a holder of the sheet feeding device. Some techniques for the sheet feeding device have been proposed that detect a leading end of the sheet roll.

SUMMARY

In one embodiment of the present disclosure, a novel sheet feeding device that feeds a sheet from a sheet roll includes a sensor, a roller, a support, circuitry, and a spool. The sensor detects a step at a leading end of the sheet roll. The roller is disposed at a position different from a position of the sensor in a circumferential direction of the sheet roll. The support supports the sensor and the roller to bring the sensor and the roller into contact with a surface of the sheet roll. The circuitry acquires a signal from the sensor as a sensor signal. The spool is insertable through a sheet tube of the sheet roll to rotate the sheet roll in conjunction with rotation of the spool. The sensor and the roller face an axial center of the spool. The support is pivotable within a range in which the sensor does not contact the spool. The circuitry detects a first inclination of the sensor signal when the leading end of the sheet roll passes by the roller and a second inclination of the sensor signal when the leading end of the sheet roll passes by the sensor, to determine whether the leading end of the sheet roll is present.

In another embodiment of the present disclosure, a novel sheet feeding device that feeds a sheet from a sheet roll includes a sensor, a roller, a support, circuitry, and a spool. The sensor detects a step at a leading end of the sheet roll. The roller is disposed at a position different from a position of the sensor in a circumferential direction of the sheet roll. The support supports the sensor and the roller to bring the sensor and the roller into contact with a surface of the sheet roll. The circuitry acquires a signal from the sensor as a sensor signal. The spool is insertable through a sheet tube of the sheet roll to rotate the sheet roll in conjunction with rotation of the spool. The sensor and the roller face an axial center of the spool. The support is pivotable within a range in which the sensor does not contact the spool The circuitry is configured to detect an inclination of the sensor signal when the leading end of the sheet roll passes by the sensor, determine, when detecting the inclination at an nth rotation of the sheet roll or the spool, whether the inclination is detected again at an (n+1)th rotation of the sheet roll or the spool, where n is an integer of one or more, and determine that the leading end of the sheet roll is present when continuously detecting the inclination for a given number of rotations of the sheet roll or the spool.

Also described is a novel image forming apparatus incorporating the sheet feeding device.

BRIEF DESCRIPTION OF THE DRAWINGS

A more complete appreciation of embodiments of the present disclosure and many of the attendant advantages and features thereof can be readily obtained and understood from the following detailed description with reference to the accompanying drawings, wherein:

FIG. 21 is a table of symbols used in the flowcharts of FIGS. 19, 20, 27, and 28;

Figure 1:
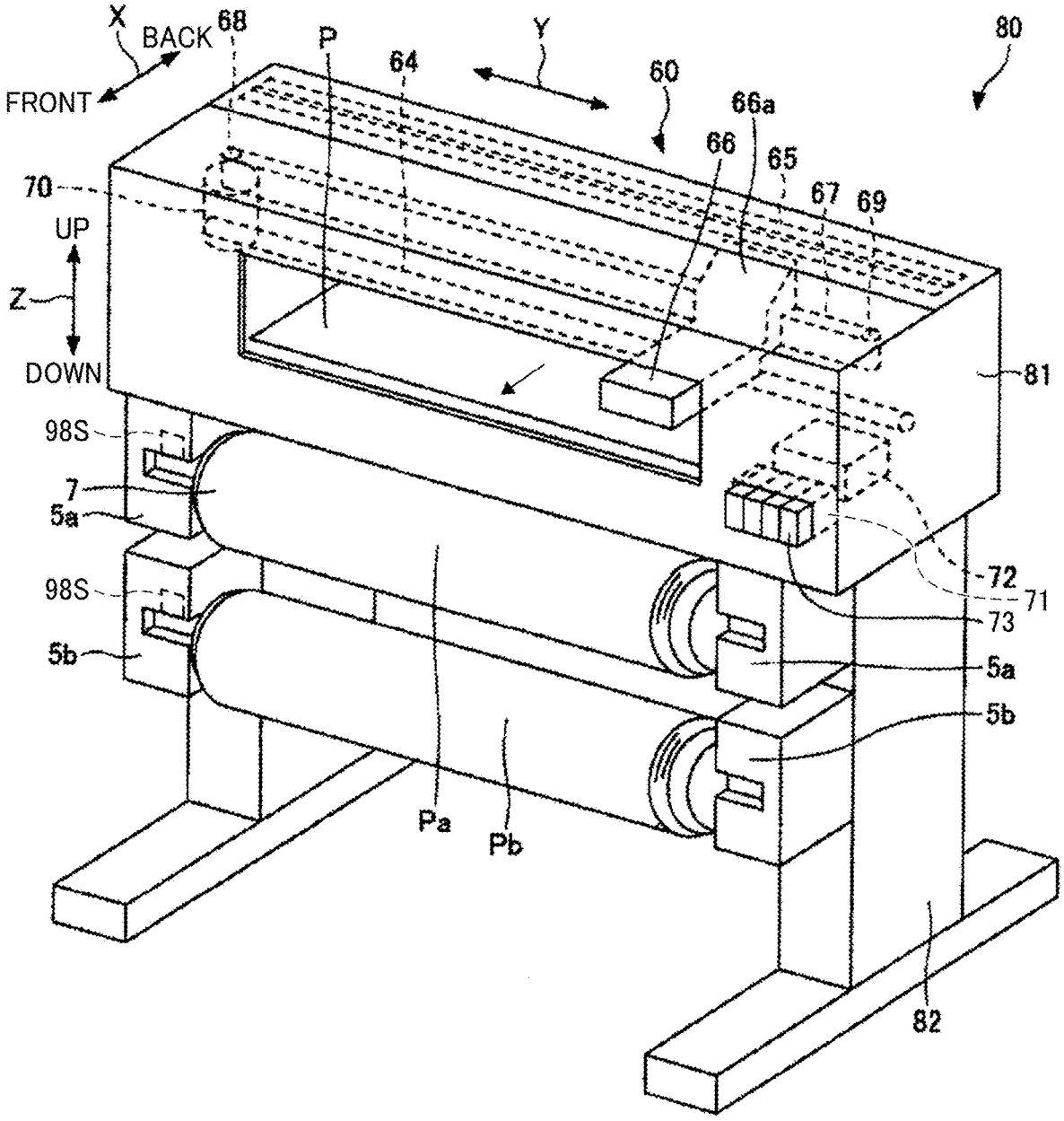
FIG. 1 is a schematic view of an image forming apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted. Also, identical or similar reference numerals designate identical or similar components throughout the several views.

DETAILED DESCRIPTION

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

Referring now to the drawings, embodiments of the present disclosure are described below. As used herein, the singular forms "a," "an," and "the" are intended to include the plural forms as well, unless the context clearly indicates otherwise.

For the sake of simplicity, like reference numerals are given to identical or corresponding constituent elements such as parts and materials having the same functions, and redundant descriptions thereof are omitted unless otherwise required.

As used herein, the term "connected/coupled" includes both direct connections and connections in which there are one or more intermediate connecting elements.

According to an aspect of the present disclosure, a sheet feeding device that feeds a sheet from a sheet roll that is a wound long sheet includes a sensor, a roller, a support, a controller (or circuitry), and a spool.

The sensor and the roller are disposed on the support. The support supports the sensor and the roller to bring the sensor and the roller into contact with a surface of the sheet roll. The controller acquires a signal from the sensor as a sensor signal.

The sheet roll includes a sheet tube inside. The spool is inserted through the sheet tube when the sheet roll is disposed in the sheet feeding device. The sheet roll rotates in conjunction with the rotation of the spool.

The sensor and the roller face an axial center of the spool.

The roller is disposed at a position different from a position of the sensor in a circumferential direction of the sheet roll.

The sensor detects a step at a leading end of the sheet roll with accuracy.

The controller detects a first inclination of the sensor signal when the leading end of the sheet roll passes by the roller and a second inclination of the sensor signal when the leading end of the sheet roll passes by the sensor, to determine whether the leading end of the sheet roll is present.

The support is pivotable within a range in which the sensor does not contact the spool.

According to another aspect of the present disclosure, a sheet feeding device that feeds a sheet from a sheet roll that is a wound long sheet includes a sensor, a roller, a support, a controller (or circuitry), and a spool.

The sensor and the roller are disposed on the support. The support supports the sensor and the roller to bring the sensor and the roller into contact with a surface of the sheet roll. The controller acquires a signal from the sensor as a sensor signal.

The sheet roll includes a sheet tube inside. The spool is inserted through the sheet tube when the sheet roll is disposed in the sheet feeding device. The sheet roll rotates in conjunction with the rotation of the spool.

The sensor and the roller face an axial center of the spool.

The roller is disposed at a position different from a position of the sensor in a circumferential direction of the sheet roll.

The sensor detects a step at a leading end of the sheet roll with accuracy.

The support is pivotable within a range in which the sensor does not contact the spool.

The controller detects an inclination of the sensor signal when the leading end of the sheet roll passes by the sensor. When detecting the inclination at the nth rotation of the sheet roll or the spool, the controller determines whether the inclination is detected again at the (n+1)th rotation of the sheet roll or the spool. When continuously detecting the inclination for a given number of rotations of the sheet roll or the spool, the controller determines that the leading end of the sheet roll is present.

Note that "n" is an integer of one or more.

Accordingly, the sheet feeding device automatically and accurately detects that no sheet roll is set, without increasing the number of parts, and prevents processing that is to be executed when a sheet roll is set from being executed when no sheet roll is set.

The sheet feeding device according to the present embodiment feeds a sheet from a sheet roll. The sheet roll is a rolled recording medium such as a rolled long sheet of paper.

Figure 2:
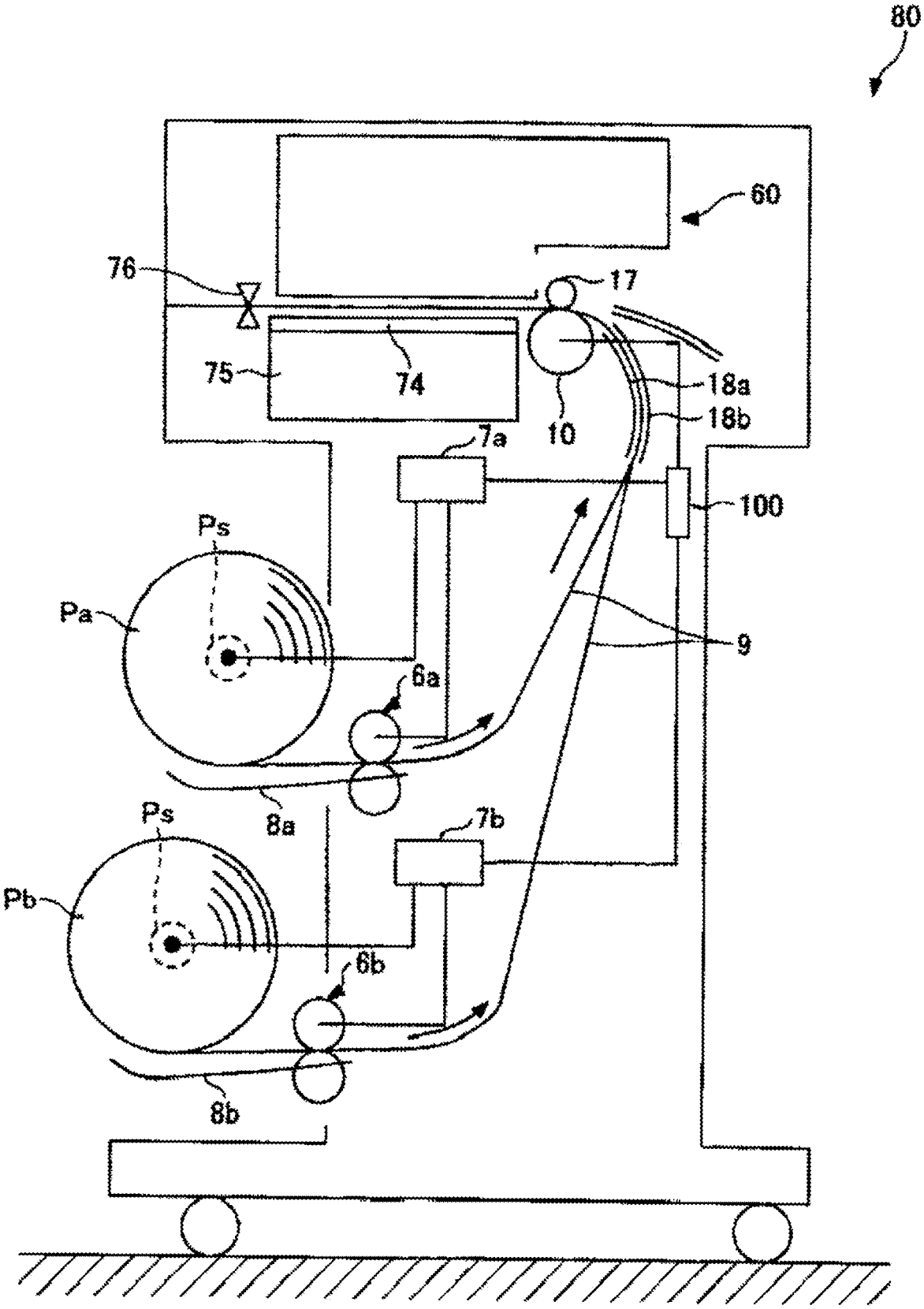
FIG. 2 is a schematic cross-sectional view of an image forming apparatus according to an embodiment of the present disclosure.

Referring now to FIGS. 1 and 2, a description is given of a configuration of an image forming apparatus that includes a sheet feeding device according to an embodiment of the present disclosure.

An image forming apparatus according to an aspect of an embodiment of the present disclosure is an ink jet printer that discharges ink droplets according to image data to print an image on a recording medium. According to another aspect of an embodiment of the present disclosure, the image forming apparatus may be an electrophotographic copier or printer that conveys a recording medium to print an image on the recording medium.

Referring now to FIGS. 1 and 2, a description is given of the overall configuration and operation of an image forming apparatus according to an embodiment of the present disclosure.

FIG. 1 is a perspective view of an image forming apparatus 80 according to an embodiment of the present disclosure. FIG. 2 is a side cross-sectional view of the image forming apparatus 80.

In FIG. 1, arrows X, Y, and Z indicate a depth direction (forward and backward directions) of the image forming apparatus 80, a width direction (main scanning direction) of the image forming apparatus 80, and a vertical direction, respectively.

In FIG. 1, the image forming apparatus 80 employs a serial liquid discharge system (ink discharge system). The image forming apparatus 80 includes a housing 81 and frames 82. The housing 81 is disposed on the frames 82. The image forming apparatus 80 further includes, inside the housing 81, a main guide rod 64 and a sub-guide rod 65 that are stretched in the main scanning direction indicated by double-headed arrow Y in FIG. 1. The main guide rod 64 supports a carriage 66 such that the carriage 66 can move. The carriage 66 is provided with a coupling piece 66*a*, which is engaged with the sub-guide rod 65 to stabilize the posture of the carriage 66.

The image forming apparatus 80 further includes as a timing belt 67 along the main guide rod 64. The timing belt 67 is an endless belt that is entrained around a driving pulley 68 and a driven pulley 69. The driving pulley 68 is driven and rotated by a main scanning motor 70. The driven pulley 69 is disposed to apply a given tension to the timing belt 67. As the main scanning motor 70 drives and rotates the driving pulley 68, the driving pulley 68 rotates the timing belt 67 in the main scanning direction according to the rotational direction of the driving pulley 68.

The carriage 66 is coupled to the timing belt 67. As the driving pulley 68 rotates the timing belt 67 in the main scanning direction, the carriage 66 reciprocates in the main scanning direction along the main guide rod 64.

The image forming apparatus 80 further includes a cartridge holder 71 and a maintenance assembly 72 that are removably accommodated at an end position in the main scanning direction inside the housing 81. The cartridge holder 71 holds cartridges 73 that contain inks of different colors, namely, yellow (Y), magenta (M), cyan (C), and black (K). Each of the cartridges 73 is replaceably accommodated in the cartridge holder 71. The carriage 66 carries recording heads for the colors of Y, M, C, and K. Each of the cartridges 73 accommodated in the cartridge holder 71 is coupled to the recording head of the corresponding color via a pipe. The ink for each of the colors of Y, M, C and K is supplied from the cartridge 73 accommodated in the cartridge holder 71 to the recording head via the pipe.

In the image forming apparatus 80, while the carriage 66 moves in the main scanning direction, the recording heads carried on the carriage 66 discharge ink onto a sheet P that is conveyed intermittently on a platen (plate) 74 illustrated in FIG. 2 in a sub-scanning direction, which is a direction indicated by arrow X in FIG. 1 and orthogonal to the main scanning direction. Thus, the image forming apparatus 80 records an image on the sheet P.

The sheet P is not limited to a sheet of paper. Various types of sheets such as a rolled film may be used as the sheet P. In the following description, for the sake of clarity, a sheet being conveyed may be referred to as the sheet P, the sheet P that is rolled may be referred to as a sheet roll Pr (Pa, Pb), and a core tube (core portion) of the sheet roll Pr may be referred to as a core tube Ps.

As illustrated in FIG. 2, the image forming apparatus 80 further includes a chamber 75 provided with a fan. The chamber 75 is disposed below the platen 74. As the fan of the chamber 75 is driven, the sheet P is conveyed on the platen 74 in close contact with the platen 74.

The image forming apparatus 80 intermittently conveys the sheet P in the sub-scanning direction. While the conveyance of the sheet P in the sub-scanning direction is stopped, the recording heads carried on the carriage 66 moving in the main scanning direction discharge ink from nozzle rows onto the sheet P on the platen 74. Thus, the image forming apparatus 80 forms or records an image on the rolled sheet P.

For example, the maintenance assembly 72 cleans a discharge face of each of the recording heads, caps the recording heads, and discharges unnecessary ink from the recording heads. Thus, the maintenance assembly 72 discharges unnecessary ink from the recording heads and maintains the reliability of the recording heads.

The image forming apparatus 80 further includes an encoder sheet parallel to the timing belt 67 and the main guide rod 64 over at least a moving range of the carriage 66.

An encoder sensor is attached to the carriage 66 to read an encoder sheet. The image forming apparatus 80 controls the driving of the main scanning motor 70 based on the readings of the encoder sheet indicated by the encoder sensor, to control the movement of the carriage 66 in the main scanning direction.

Reflective sensors carried on the carriage 66, such as the encoder sensor and a sheet-leading-end sensor, detect opposed ends of the sheet P conveyed to an image forming device 60. At that time, the size of the sheet P is detected based on the positions of the opposed ends of the sheet P in the main scanning direction read by the sheet-leading-end sensor, which is a sensor for detecting a leading end of a sheet.

As illustrated in FIGS. 1 and 2, the image forming apparatus 80 further includes two spool bearing bases 5*a* and 5*b* that are disposed in the vertical direction in FIGS. 1 and 2 on the frames 82 supporting the housing 81.

The sheet rolls Pr are set on the spool bearing bases 5*a* and 5*b*. Specifically, the sheet roll Pa is set on the spool bearing base 5*a* whereas the sheet roller Pb is set on the spool bearing base 5*b* as illustrated in FIG. 1. When the sheet P is drawn from the leading end of the sheet roll Pa set on the spool bearing base 5*a*, the sheet P (or rolled sheet P) is conveyed by a conveyance roller pair 6*a*, a registration roller 10, and a registration pressure roller 17 along a corresponding one of sheet conveyance passages 9, as indicated by arrows in FIG. 2. Similarly, when the sheet P is drawn from the leading end of the sheet roll Pb set on the spool bearing base 5*b*, the sheet P (or rolled sheet P) is conveyed by a conveyance roller pair 6*b*, the registration roller 10, and the registration pressure roller 17 along a corresponding one of the sheet conveyance passages 9, as indicated by an arrow in FIG. 2.

Figure 6:
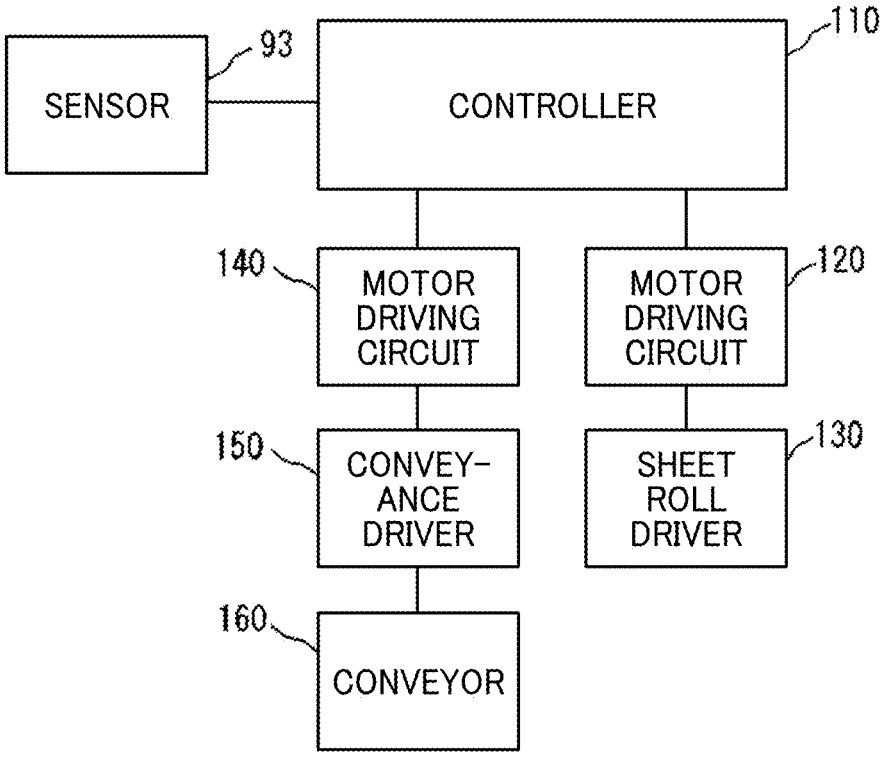
FIG. 6 is a functional block diagram of a sheet feeding device according to an embodiment of the present disclosure.

A controller 110 illustrated in FIG. 6 causes a driving device 7 (i.e., driving devices 7*a* and 7*b* illustrated in FIG. 2) to rotate, for example, the conveyance roller pairs 6*a* and 6*b*, the registration roller 10, and the registration pressure roller 17.

Sheet roll receivers 8*a* and 8*b* are disposed below the sheet roll Pa and the sheet roll Pb, respectively, to prevent the sheet rolls Pr (i.e., the sheet rolls Pa and Pb) from falling.

The sheet P passes through the sheet conveyance passage 9 supported and defined by, for example, medium conveyance guides 18*a* and 18*b*. Then, the sheet P is conveyed onto the platen 74 in the image forming device 60.

In the image forming device 60, the recording heads discharge ink droplets of the colors of Y, M C, and K onto the sheet P according to image data. Thus, the image forming device 60 forms an image on the sheet P. A cutter 76 extending in the sub-scanning direction (i.e., the sheet width direction) is disposed at a sheet ejection portion in the forward conveying direction of the sheet P on which the image is formed, to cut the sheet P that is a continuous sheet to a given length.

The cutter 76 is fixed to a wire and a timing belt entrained around a plurality of pulleys, one of which is coupled to a drive motor, to align the leading end of the sheet P, which is a continuous sheet fed and conveyed from the sheet roll Pr. As the drive motor drives, the cutter 76 moves in the main scanning direction indicated by arrow Y in FIG. 1 to cut the sheet P to the given length. The cut sheet P is ejected to the sheet ejection portion.

Although FIGS. 1 and 2 illustrate the configuration of the image forming apparatus 80 as an example configuration of an image forming apparatus that can load the sheet rolls Pa and Pb on the spool bearing bases 5*a* and 5*b*, respectively, the image forming apparatus may include one spool bearing base in another embodiment of the present disclosure.

In the above description, the components relative to the sheet roll Pa has been distinguished from the components relative to the sheet roll Pb by different suffixes. Specifically, reference numerals with suffix "a" are given to the components relative to the sheet roll Pa whereas reference numerals with suffix "b" are given to the components relative to the sheet roll Pb (e.g., the spool bearing bases 5*a* and 5*b*). In the following description, the suffixes "a" and "b" may be omitted unless otherwise required.

In the present embodiment, for example, a sensor 98S may be disposed on each of the spool bearing bases 5*a* and 5*b* to detect whether the spool is set. The sensor 98S may be referred to as a spool sensor. The spool sensor allows detection as to whether the sheet roll is set and processing such as displaying a sheet feeding screen when the sheet roll is set.

Referring now to FIGS. 3A to 3E, a description is given of a typical way of setting a sheet roll.

FIGS. 3A to 3E are diagrams illustrating a typical way of setting a sheet roll.

Figure 3A:
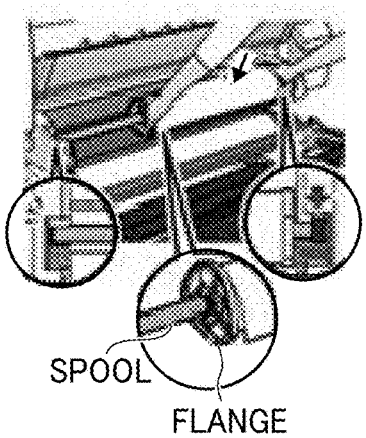
FIG. 3A RELATED ART
FIGS. 3A to 3E are diagrams illustrating a typical way of setting a sheet roll.
Figure 3B:
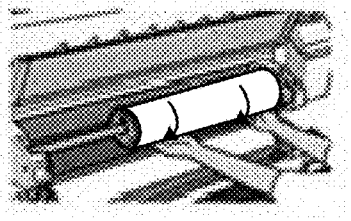
FIG. 3B RELATED ART
Figure 3C:
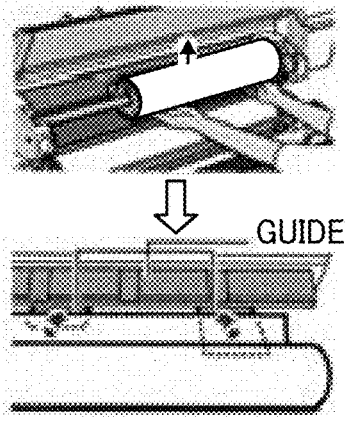
FIG. 3C RELATED ART

A flange is disposed at a latitudinal end of the sheet roll Pr so that a spool is set to the flange. As illustrated in FIG. 3A, a user sets the sheet roll with the spool on a sheet-feeder receiver (i.e., a spool bearing base) of an image forming apparatus. After finding the leading end of the sheet from the sheet roll, the user holds the sheet roll while keeping (without losing) the leading end of the sheet with both hands as illustrated in FIG. 3B. Then, the user rotates the sheet roll so that the leading end of the sheet comes to the front. Then, the user positions the leading end of the sheet between guide plates serving as guides behind the sheet roll and inserts the leading end of the sheet while rotating the sheet roll as illustrated in FIG. 3C. The guide plates include an upper guide plate and a lower guide plate. Each of the guide plates is made of a transparent material so that the sheet can be seen through the guide plates. When the user rotates the sheet roll to the back so that the leading end of the sheet comes above the lower guide plate and inserts the sheet to the back of the guide plates, the sheet is fixed inside and drawn into the image forming apparatus.

As illustrated in FIG. 3C, since the guide plates between which the leading end of the sheet is inserted is located behind the sheet roll, the guide plates are hidden by the sheet roll and difficult to see. In addition, the guide plates are transparent. For these reasons, for example, the user may fail to insert the leading end of the sheet between the two guide plates and unintentionally place the sheet on the top of the upper guide plate. As a result, the user has to insert the leading end of the sheet between the guide plates again. In a case where each of the guide plates is made of an untransparent material, the user may have some difficulties in confirming that the sheet is inserted between the two guide plates.

In addition, inserting the leading end of the sheet roll as evenly as possible is troublesome. When the leading end of the sheet is not evenly inserted, the sheet may be obliquely fed and causes a skew, which leads to re-operation or occurrence of a paper jam.

Figure 3D:
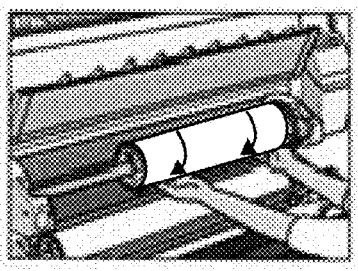
FIG. 3D RELATED ART
Figure 3E:
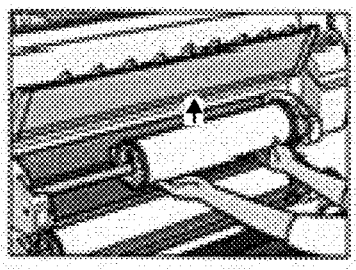
FIG. 3E RELATED ART

In an image forming apparatus that can accommodate sheet rolls vertically as illustrated in FIGS. 3D and 3E, in a case where a sheet roll is set lower than another sheet roll that has already been set and the leading end of the lower sheet roll is inserted between the guide plates, the guide plates are more difficult to see because of the upper sheet roll that has already been set, resulting in an increase in difficulty in setting the sheet roll and an increase in chances of the oblique insertion of the sheet.

To address such unfavorable situations as described above, a sheet feeding device according to an embodiment of the present disclosure detects, with a sensor, a step of a leading end of a sheet of a sheet roll to detect the leading end of the sheet and conveys the sheet to a sheet feeder. A medium supplier supplies the sheet of the sheet roll to a destination where the sheet is to be supplied. Examples of the medium supplier include, but are not limited to, the conveyance roller pairs 6*a* and 6*b* and the sheet conveyance passage 9 illustrated in FIG. 2.

FIGS. 4A to 4F are diagrams illustrating how to set a sheet roll on a spool.

Figure 4A:
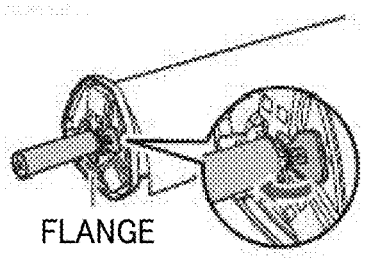
FIGS. 4A to 4F are diagrams illustrating how to set a sheet roll on a spool.
Figure 4B:
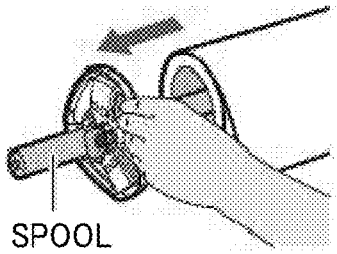
Figure 4C:
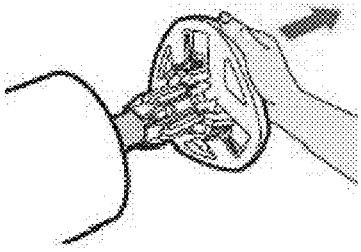
Figure 4D:
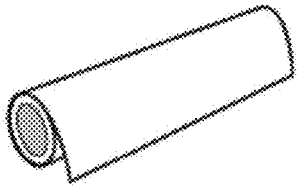
Figure 4E:
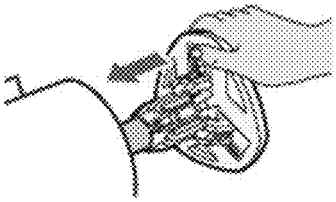
Figure 4F:
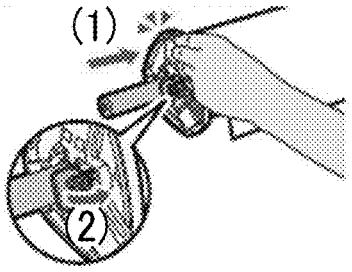

FIGS. 4A to 4C illustrate how to remove an old sheet roll. FIGS. 4D to 4F illustrate how to set a new sheet roll. As illustrated in FIGS. 4A to 4C, flanges are disposed at opposed ends of the spool. After the flanges are removed, the old sheet roll is removed from the spool. Next, as illustrated in FIGS. 4D to 4F, the spool is inserted through a new sheet roll and the flanges are set. Specifically, in FIG. 4A, a user raises the rocking lever on the left-side flange. In FIG. 4B, the user removes the left-side flange from the spool. In FIG. 4C, the user pulls out the right-side flange with the spool from the sheet roll or the sheet tube. In FIG. 4D, the user prepares a new sheet roll for replacement. In FIG. 4E, the user inserts the flange with the spool from the right side of the sheet roll until the flange abuts against the sheet roll. At this time, the user sets the sheet roll in the illustrated direction. The user slowly inserts the flange with the sheet roll placed horizontally. The user has to be careful not to drop the sheet roll on its stand or otherwise subject the sheet roll to impact. In FIG. 4F, the user slowly fit the left-side flange to the spool until the left-side flange rests on the spool, without giving any impact, as indicated by numeral (1) in FIG. 4F. The, the user pulls down the locking lever as indicated by numeral (2) in FIG. 4F.

Although the old sheet is illustrated in FIGS. 4A to 4C, a sheet tube disposed inside the old sheet roll may be removed from the spool when no sheet remains. The sheet roll includes a sheet tube inside. The sheet roll is disposed or set in the sheet feeding device with the spool inserted through the sheet tube. In the present embodiment, the flanges are used to allow the sheet roll to rotate in conjunction with the rotation of the spool. However, in another embodiment, components other than the flanges may be used to allow the sheet roll to rotate in conjunction with the rotation of the spool.

The spool may be referred to as a spool shaft or may be simply referred to as a shaft. The spool is, for example, cylindrical. The inside of the cylinder may or may not be hollow. The configuration of the spool is not particularly limited and may be selected as appropriate. Although the spool does not contact the sheet tube in principle, the spool may contact the sheet tube.

Figure 5:
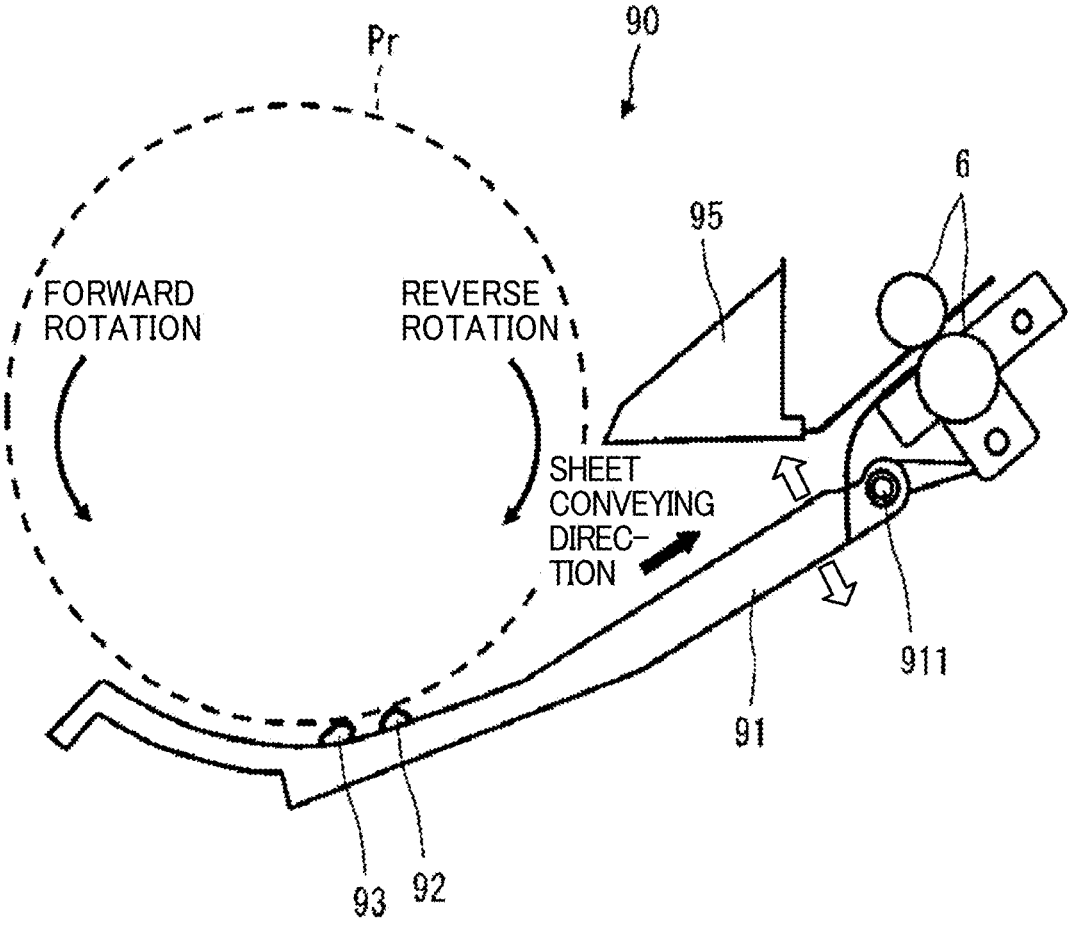
FIG. 5 is a side view of a sheet feeding device according to an embodiment of the present disclosure.

FIG. 5 is a side view of a sheet feeding device according to an embodiment of the present disclosure.

A sheet feeding device 90 includes at least an arm 91, a roller 92, a sensor 93, and a conveyance roller pair 6 serving as a conveyor. The sheet feeding device 90 may further include an entrance guide plate 95.

In FIG. 5, the broken line indicates the position of the sheet roll Pr when a user sets the sheet roll Pr in the sheet feeding device 90. The sheet roll Pr is rotatably held by a module component about the center (i.e., the axis) of the sheet roll Pr.

The arm 91 serving as a guide plate and a support for the sheet roll Pr is pivotable about a pivot 911. The arm 91 is pressed toward the sheet roll Pr or a spool by, for example, a spring at a position close to the pivot 911. Accordingly, the arm 91 contacts an outer diameter of the sheet roll Pr regardless of the diameter of the sheet roll Pr. Thick arrows indicate directions in which the arm 91 is pivoted.

The arm 91 is provided with the roller 92 and the sensor 93 at a position far from the pivot 911. The arm 91 pressed toward the sheet roll Pr supports the roller 92 and the sensor 93 such that the roller 92 and the sensor 93 contact the surface of the sheet roll Pr.

The arm 91 acts as a guide plate that guides the sheet of the sheet roll Pr in a conveying direction of the sheet, which may be referred to as a sheet conveying direction in the following description. An end portion of the arm 91 on which the sheet rolls Pr is set may have, for example, an arc shape along the outer diameter of the sheet roll Pr to hold the sheet roll Pr and prevent the sheet roll Pr from falling when a user sets the sheet roll Pr. The arm 91 also functions as a sheet roll receiver equivalent to each of the sheet roll receivers 8*a* and 8*b* in FIG. 2.

The arm 91 serving as a support and a guide plate that guides the sheet roll Pr reduces the number of parts and the cost.

The roller 92 and the sensor 93 are disposed facing substantially the center of the sheet roll Pr, in other words, toward an axial center of the sheet roll Pr, regardless of the diameter of the sheet roll Pr.

The roller 92 is disposed at a position different from the position of the sensor 93 in a circumferential direction of the sheet roll Pr. In other words, the roller 92 and the sensor 93 are offset from each other in the circumferential direction of the sheet roll Pr.

The sensor 93 has a detection accuracy that allows the sensor 93 to detect a step, caused by the thickness of the sheet P, at the leading end of the sheet roll Pr. In other words, the sensor 93 detects the step at the leading end of the sheet roll Pr with accuracy.

The entrance guide plate 95 guides, in the sheet conveying direction, the sheet that has been stripped off or separated from the sheet roll Pr. In the example illustrated in FIG. 5, when the sheet roll Pr rotates in the forward direction to feed the sheet P, the arm 91 acting as a guide plate guides the sheet P at an upstream position in the sheet conveying direction while the entrance guide plate 95 guides the sheet P at a downstream position in the sheet conveying direction.

Referring now to FIG. 6, a description is given of the control of functions of the sheet feeding device 9) according to an embodiment of the present disclosure.

FIG. 6 is a functional block diagram of the sheet feeding device 90 according to an embodiment of the present disclosure.

The controller 110 controls the entire sheet feeding device. For example, FIG. 6 illustrates a functional block diagram in which the controller 110 controls the sensor 93 and motor driving circuits 120 and 140. The functions of the controller 110 may be executed by a controller 100, illustrated in FIG. 2, which controls the entire image forming apparatus 80.

The controller 110 includes, for example, a central processing unit (CPU), a random access memory (RAM), and a read only memory (ROM).

The CPU executes various programs and controls the entire image forming apparatus 80 according to arithmetic processing and control programs.

The RAM is a volatile storage medium that allows data to be read written at high speed. The CPU uses the RAM as a work area when executing a program.

The ROM is a read-only non-volatile storage medium that stores various programs and control programs.

The motor driving circuit 120 drives a motor under the control of the controller 110 to drive a sheet roll driver 130.

The sheet roll driver 130 rotates the sheet roll Pr in the forward direction or the reverse direction. The sheet roll driver 130 is implemented by, for example, a sheet roll rotation motor.

The motor driving circuit 140 drives a motor under the control of the controller 110 to drive a conveyance driver 150.

The conveyance driver 150 drives a conveyor 160.

The conveyor 160 conveys the sheet P. The conveyor 160 is implemented by, for example, the conveyance roller pair 6.

Now, a description is given of a configuration of the arm 91 as a support and a leading-end detecting operation, which is an operation to detect the leading end of the sheet roll Pr.

Figure 7A:
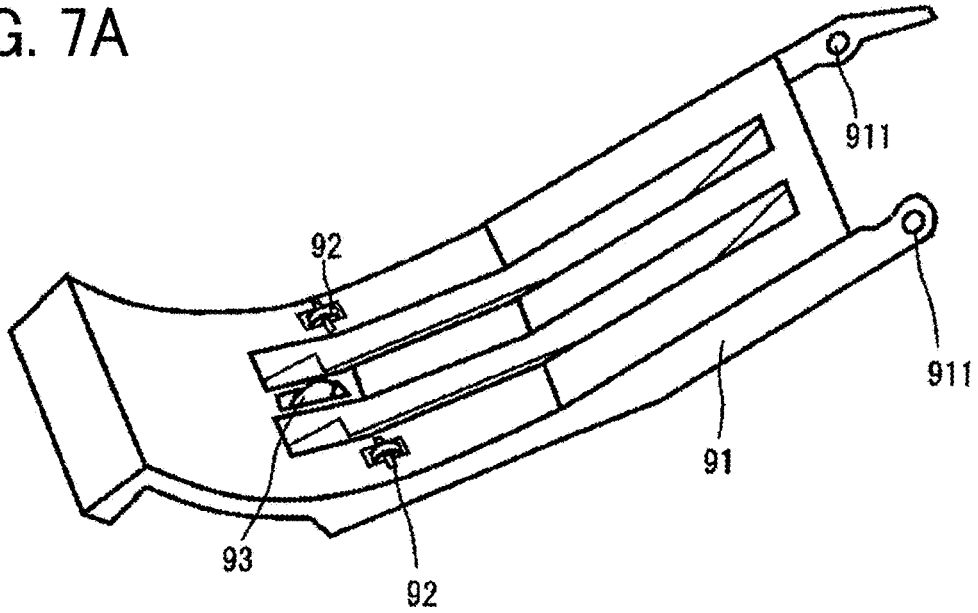
FIGS. 7A to 7C are diagrams illustrating a configuration of an arm according to an embodiment of the present disclosure.
Figure 7B:
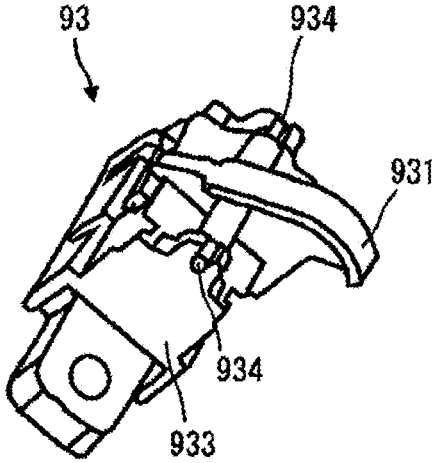
Figure 7C:
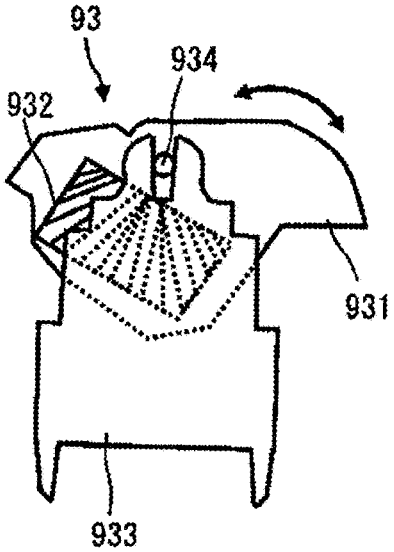

FIGS. 7A to 7C are diagrams illustrating a configuration of the arm 91 according to an embodiment of the present disclosure.

Specifically, FIG. 7A is a perspective view of the arm 91. FIG. 7B is a schematic view of the exterior of the sensor 93. FIG. 7C is a side view of an actuator and a side plate, each included in the sensor 93.

The arm 91 is disposed to locate the sensor 93 downstream from the roller 92 in the sheet conveying direction along a direction of the reverse rotation of the sheet roll Pr in an operation in which the sensor 93 detects the leading end of the sheet roll Pr that rotates in the reverse rotation.

The sensor 93 is, for example, an encoder sensor that includes an actuator 931 provided with slits 932. The sensor 93 may be referred to as a sheet thickness sensor or a leading-end sensor.

The actuator 931 is disposed between two side plates 933 that construct a housing of the sensor 93. A shaft 934 is fitted in a bearing of the side plates 933. The actuator 931 is pivoted about the shaft 934. For example, the actuator 931 is asymmetric about the shaft 934 as illustrated in FIG. 7C.

The sensor 93 includes a light emitting portion and a light receiving portion. The number of lights passing from the light emitting portion to the light receiving portion through the slits 932 of the actuator 931 is counted, in other words, the number of signal waveforms is counted, to detect the leading end of the sheet roll Pr. For example, the sensor 93 has a resolution of about 5 μm/pulse to detect a step corresponding to the thickness of the sheet P.

In the example configuration illustrated in FIGS. 7A to 7C, the sensor 93 is disposed between two rollers 92. Such a configuration reliably restrains the floating of the leading end of the sheet roll Pr and prevents an unstable output of the sensor 93 depending on the thickness, stiffness, or curling of the sheet P. Accordingly, the sensor 93 reliably detects the leading end of the sheet roll Pr. Since the rollers 92 and the sensor 93 are disposed offset from each other in the circumferential direction of the sheet roll Pr, a partial scratch is less likely to be extended on both the rollers 92 and the sensor 93. Thus, an erroneous detection is prevented.

In the following description, the two or more rollers 92 may be referred to as rollers or a roller unit.

Figure 8A:
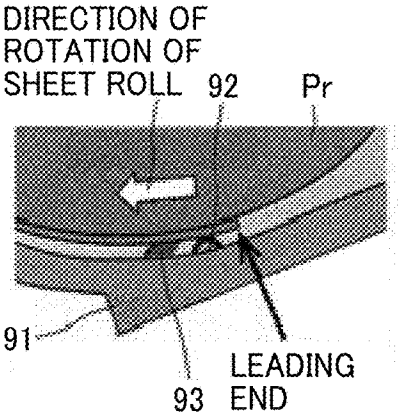
FIGS. 8A to 8C are diagrams illustrating an operation to detect a leading end of a sheet roll.
Figure 8B:
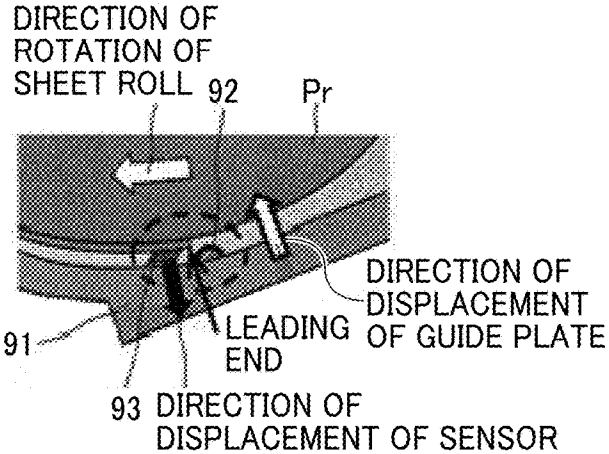
Figure 8C:
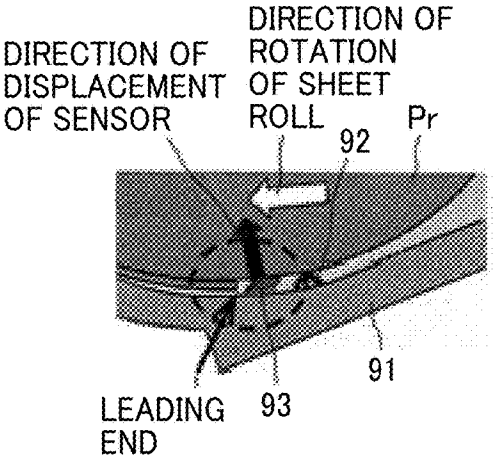
Figure 9A:
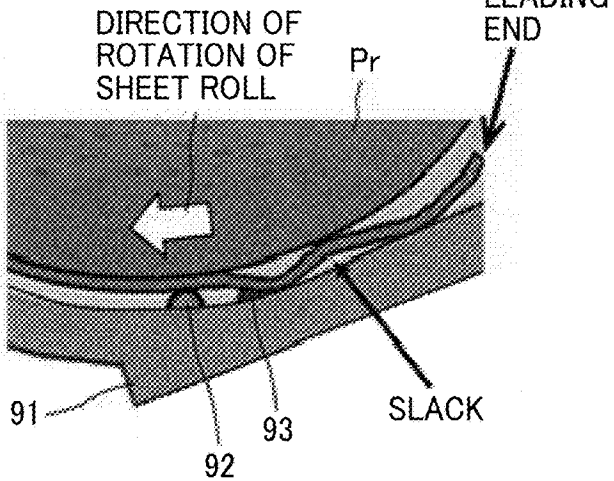
FIGS. 9A and 9B are diagrams illustrating a difference in the relative positions of a roller and a sensor.
Figure 9B:
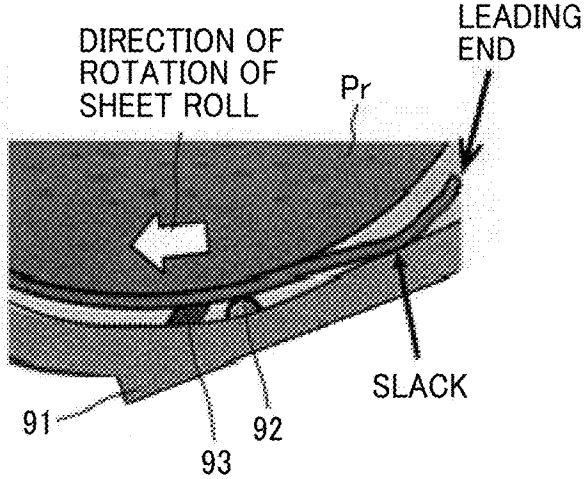

FIGS. 8A to 8C are diagrams illustrating an operation to detect the leading end of the sheet roll Pr. FIGS. 9A and 9B are diagrams illustrating a difference in the relative positions of the roller 92 and the sensor 93.

Specifically. FIGS. 8A to 8C illustrate the leading end of the sheet roll Pr passing by the rollers 92 and the sensor 93. More specifically, FIG. 8A illustrates the leading end of the sheet roll Pr before passing by the rollers 92. FIG. 8B illustrates the leading end of the sheet roll Pr after passing by the rollers 92 and before passing by the sensor 93. FIG. 8C illustrates the leading end of the sheet roll Pr after passing by the sensor 93.

FIGS. 9A and 9B illustrate a difference in occurrence of slack of the sheet roll Pr in the leading-end detecting operation. Specifically, FIG. 9A illustrates the sheet roll Pr slacked in a case where the rollers 92 are disposed downstream from the sensor 93 in the sheet conveying direction. FIG. 9B illustrates the sheet roll Pr slacked in a case where the rollers 92 are disposed upstream from the sensor 93 in the sheet conveying direction.

The sensor 93 and the rollers 92 are disposed close to each other and offset from each other in the circumferential direction of the sheet roll Pr. Such a configuration allows the rollers 92 disposed upstream from the sensor 93 in the sheet conveyance direction to keep pressing the leading end of the roll sheet Pr until immediately before the sensor 93 detects the leading end of the sheet roll Pr, as illustrated in FIG. 8A. As a result, the sensor 93 detects the step (thickness) on the surface of the sheet roll Pr as the leading end of the sheet roll Pr with the leading end of the sheet roll Pr in close contact with the surface of the sheet roll Pr, as illustrated in FIG. 8B. Accordingly, the output of the sensor 93 (i.e., the result of detection performed by the sensor 93) is stabled regardless of the thickness, stiffness, or curling of the sheet P. In short, the sensor 93 reliably detects the leading end of the sheet roll Pr.

Although the rollers 92 are disposed upstream from the sensor 93 in the sheet conveying direction in the present embodiment, the leading end of the sheet roll Pr may be detected in a case where the rollers 92 are disposed downstream from the sensor 93 in the sheet conveying direction as illustrated in FIG. 9A. However, the arrangement illustrated in FIG. 9B is more preferable to the arrangement illustrated in FIG. 9A, to reliably restrain the floating of the leading end of the sheet roll Pr until immediately before the detection of the leading end of the sheet roll Pr.

In addition, the case where the sensor 93 is disposed between the two rollers 92 as illustrated in FIG. 7A is more preferable to the case where the sensor 93 is disposed together with the single roller 92, to reliably restrain the floating of the leading end of the sheet roll Pr.

Now, a description is given of a signal acquired from the sensor 93.

Figure 10A:
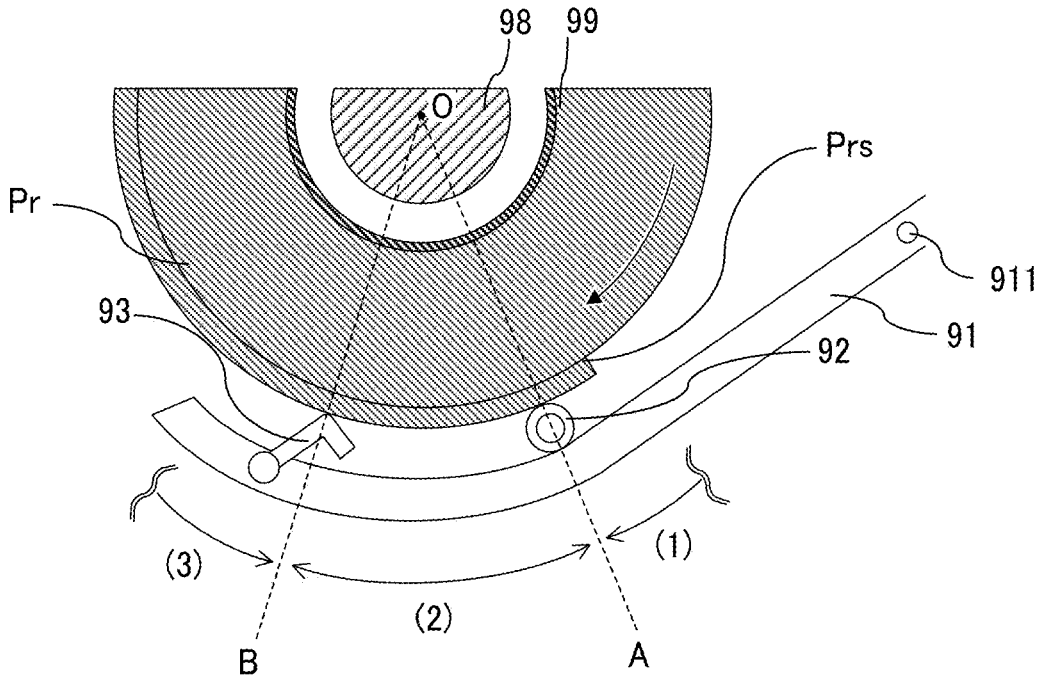
FIG. 10A is a diagram illustrating relative positions of a roller, a sensor, and a leading end of a sheet roll.
Figure 10B:
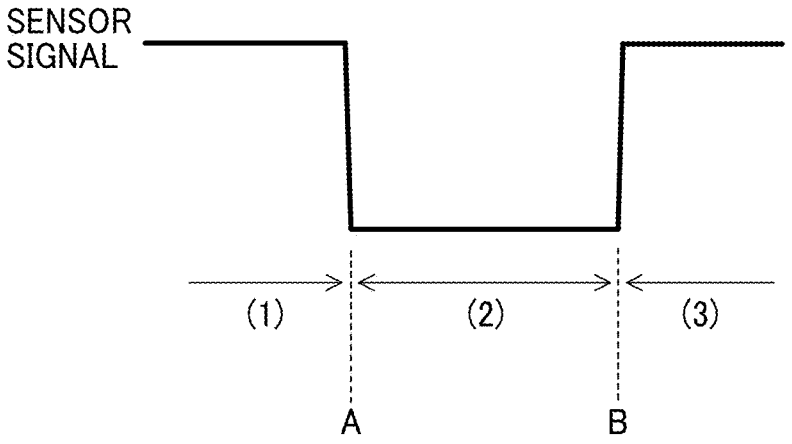
FIG. 10B is a diagram illustrating a signal waveform of the sensor illustrated in FIG. 10A.

FIG. 10A is a diagram illustrating the relative positions of the roller 92 and the sensor 93, the arm 91 provided with the roller 92 and the sensor 93, and a leading end Prs, which is the leading end of the sheet roll Pr. FIG. 10B illustrates a signal waveform acquired from the sensor 93 illustrated in FIG. 10A.

Like the example illustrated in FIGS. 8A to 8C, in the example illustrated in FIG. 10A, the roller 92 and the sensor 93 are disposed at different positions in the circumferential direction of the sheet roll Pr. In other words, the roller 92 and the sensor 93 are offset from each other in the circumferential direction of the sheet roll Pr. As illustrated in FIG. 10A, the sensor 93 and the roller 92 face an axial center O of the spool. In the leading-end detecting operation, the roller 92 is disposed upstream from the sensor 93 in the sheet conveying direction.

In FIG. 10A, each of areas (1) to (3) corresponds to the position of the leading end Prs.

Specifically, the area (1) corresponds the position of the leading end Prs upstream from the roller 92 in the sheet conveying direction. The area (2) corresponds the position of the leading end Prs downstream from the roller 92 in the sheet conveying direction and upstream from the sensor 93 in the sheet conveying direction. The area (3) corresponds the position of the leading end Prs downstream from the sensor 93 in the sheet conveying direction.

As illustrated in FIG. 10B, the value of the sensor signal changes when the leading end Prs moves from the area (1) to the area (2) and when the leading end Prs moves from the area (2) to the area (3). In the example illustrated in FIG. 10B, the value of the sensor signal in the area (1) is the same as or close to the value of the sensor signal in the area (3).

Figure 11A:
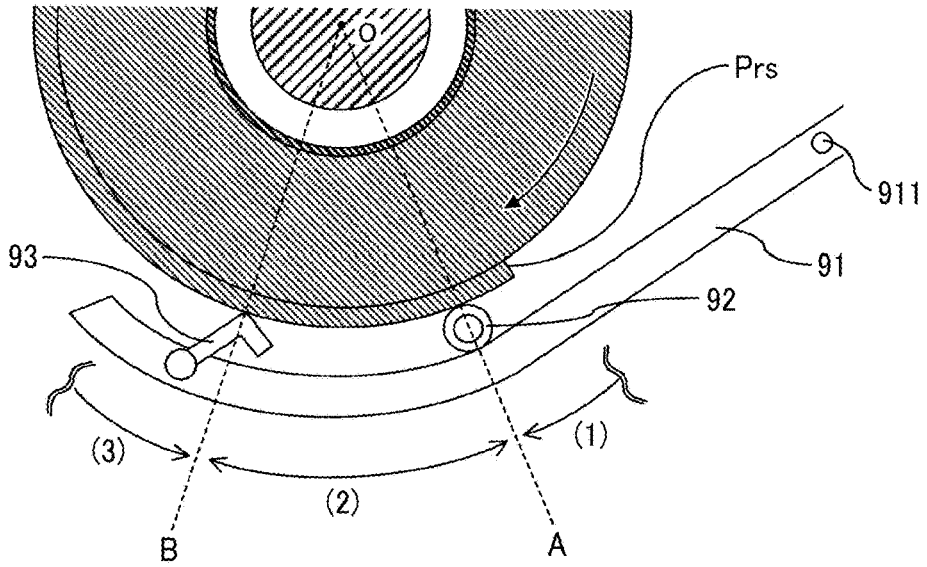
FIGS. 11A to 11C are diagrams illustrating an example of movement of a roller, a sensor, and an arm along a change in the position of a leading end of a sheet roll.
Figure 11B:
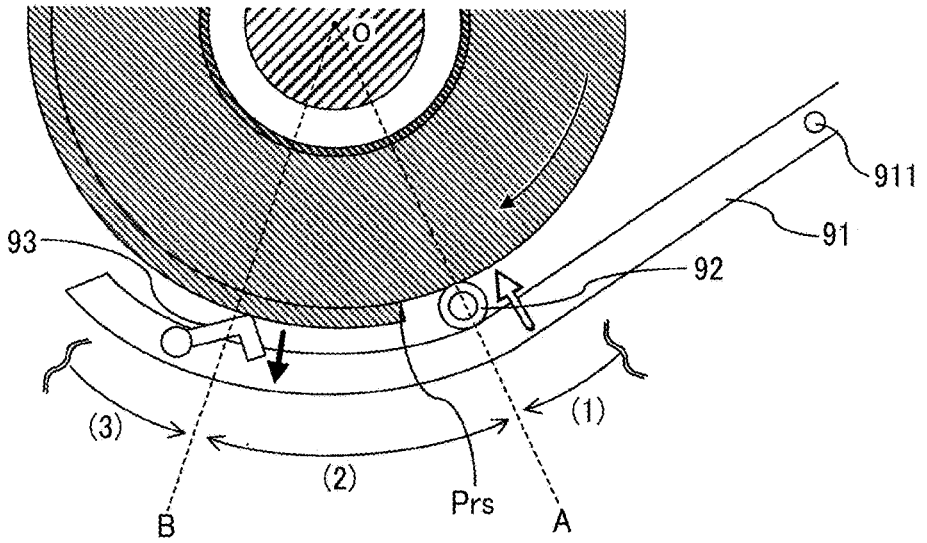
Figure 11C:
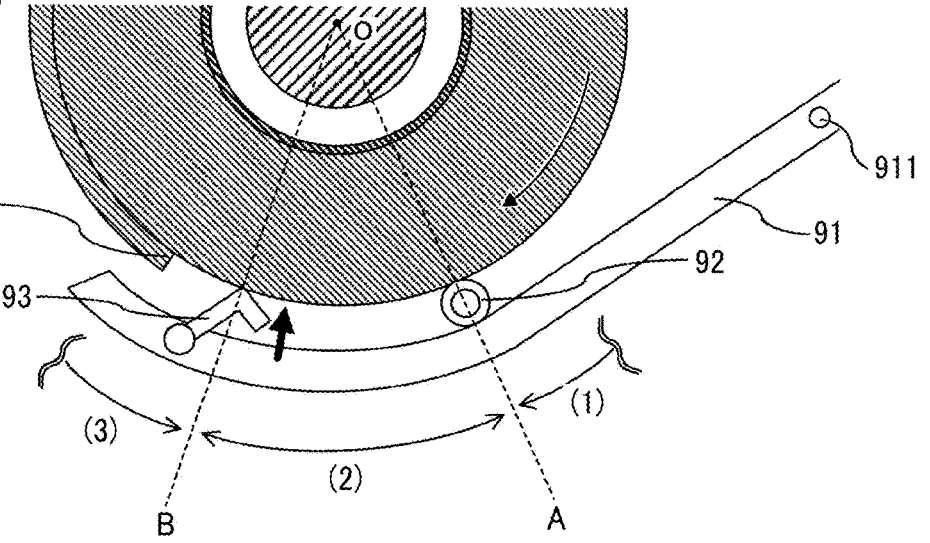

Referring now to FIGS. 11A to 11C, a description is given of the signal waveform illustrated in FIG. 10B.

FIGS. 11A to 11C are diagrams illustrating an example of movement of the roller 92, the sensor 93, and the arm 91 along a change in the position of the leading end Prs in the example illustrated in FIG. 10A.

FIG. 11A illustrates the leading end Prs moving in the area (1), as in FIG. 10A. In the area (1), the sensor signal remains unchanged and is constant or substantially constant.

FIG. 11B illustrates the leading end Prs moving in the area (2). When the leading end Prs goes beyond the area (1), in other words, after the leading end Prs passes by the roller 92, the arm 91 is pivoted toward the sheet roll Pr by the thickness of the sheet P of the sheet roll Pr, as schematically indicated by white, thick arrow in FIG. 11B. As the arm 91 is pivoted toward the sheet roll Pr, the distance between the arm 91 and the sheet roll Pr decreases. The sensor 93 changes by the decreased distance, as schematically indicated by black, thick arrow in FIG. 11B. Such a change of the sensor 93 may be expressed as a decrease in the distance between the sheet roll Pr and a base portion of the sensor 93 indicated by circle in FIG. 11B. Alternatively, such a change of the sensor 93 may be expressed as a change (or decrease) in the angle of a detection portion of the sensor 93 indicated by L shape in FIG. 11B. Because of the aforementioned change, the sensor signal decreases in the area (2), as illustrated in FIG. 10B. Alternatively, the signal waveform may indicate an increase of the sensor signal in the area (2), depending on the type of the sensor 93. When the rotation of the arm 91 is stopped in the area (2), the sensor signal becomes constant or substantially constant until the leading end Prs reaches the area (3).

FIG. 11C illustrates the leading end Prs moving in the area (3). When the leading end Prs goes beyond the area (2), in other words, after the leading end Prs passes by the sensor 93, the angle of the detection portion of the sensor 93 indicated by L shape in FIG. 11C increases by the thickness of the sheet P of the sheet roll Pr, as schematically indicated by black, thick arrow in FIG. 11B. In the area (3), since the arm 91 is not pivoted, the distance between the sheet roll Pr and the base portion of the sensor 93 indicated by circle in FIG. 11C remains unchanged. The sensor 93 in the area (3) has a shape similar to the shape of the sensor 93 in the area (1). In other words, the distance between the sheet roll Pr and the sensor 93 may be the same between the area (1) and the area (3). In other words, the value of the sensor signal in the area (3) is the same as or close to the value of the sensor signal in the area (1) as illustrated in FIG. 10B.

Figure 12:
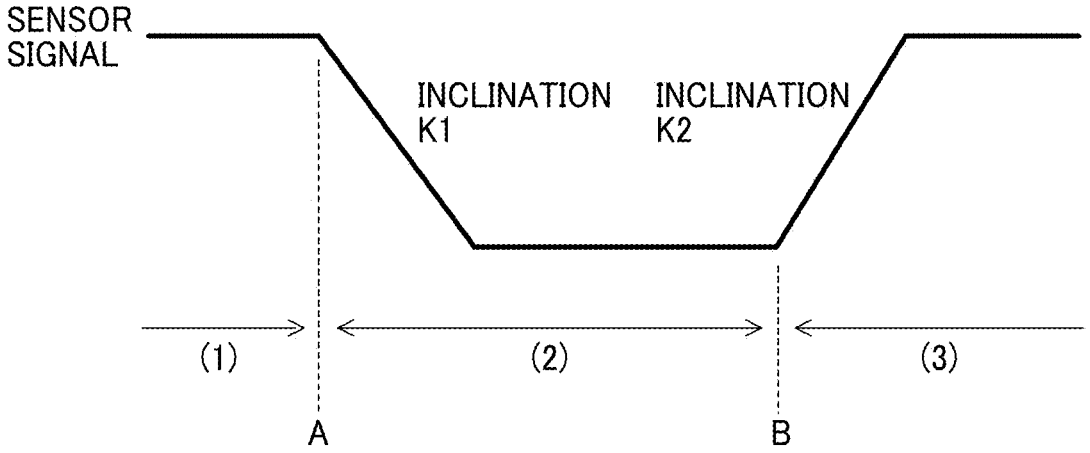
FIG. 12 is a diagram illustrating a signal waveform of a sensor when the roller, the sensor, and the arm move as illustrated in FIGS. 11A to 11C.
Figure 13A:
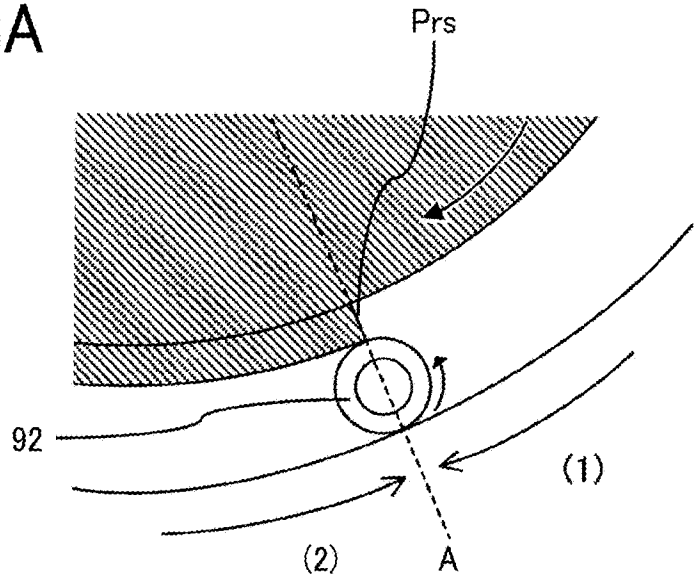
FIGS. 13A to 13D are diagrams illustrating an example of movement of a roller and an arm along a change in the position of a leading end of a sheet roll.
Figure 13B:
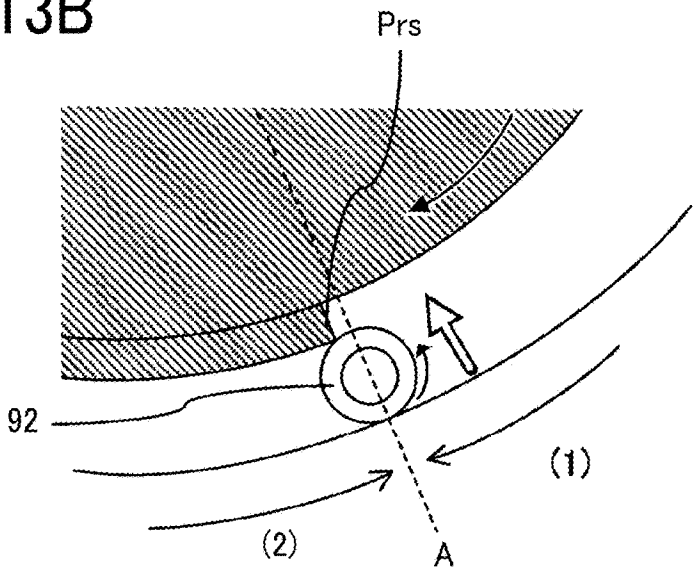
Figure 13C:
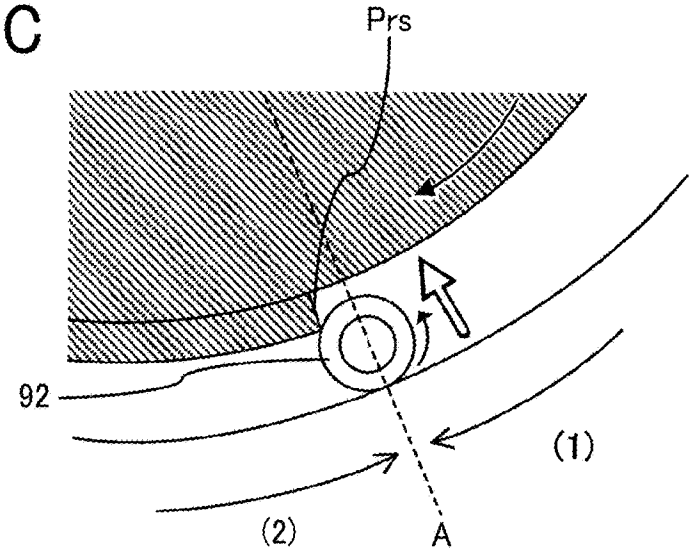
Figure 13D:
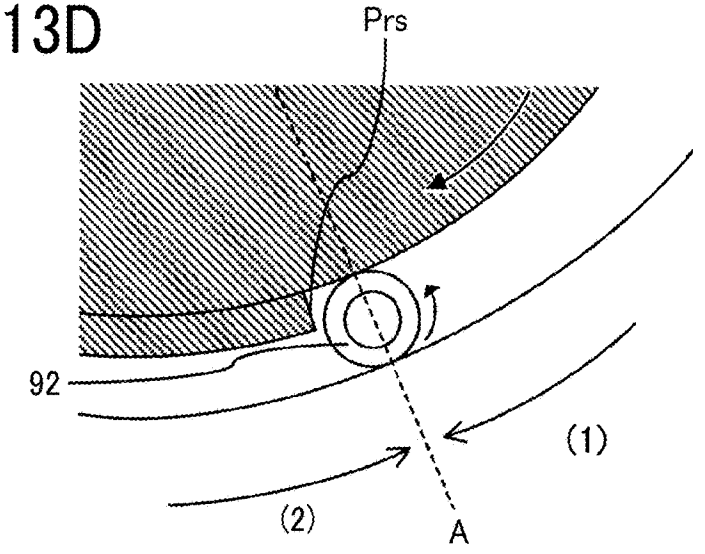
Figure 14A:
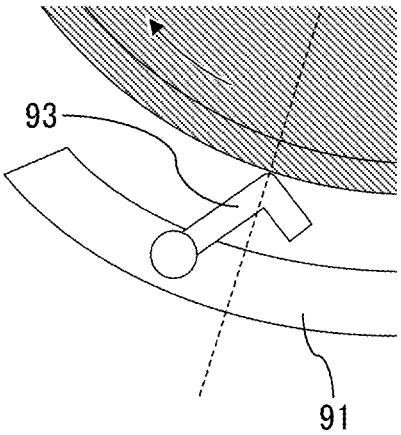
FIGS. 14A to 14D are diagrams illustrating an example of movement of a sensor along the change in the position of the leading end of the sheet roll as illustrated in FIGS. 13A to 13D.
Figure 14B:
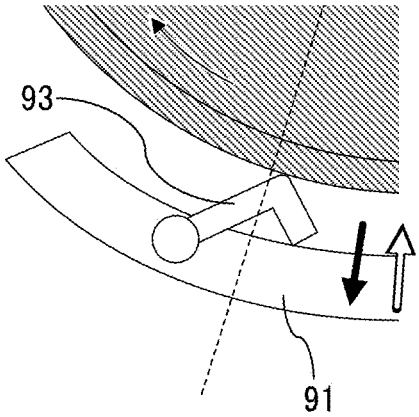
Figure 14C:
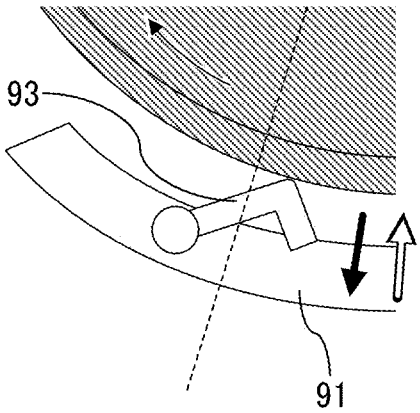
Figure 14D:
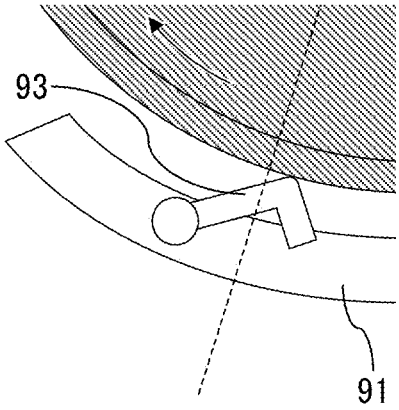

Referring now to FIG. 12, a detailed description of the signal waveform of the sensor 93 illustrated in FIG. 10B.

FIG. 12 is a diagram illustrating the signal waveform of the sensor 93 in FIG. 10B with clear boundaries of the areas (1) to (3).

As illustrated in FIG. 12, the sensor signal is inclined at the boundary between the area (1) and the area (2) and at the boundary between the area (2) and the area (3). As illustrated in FIG. 12, the sensor signal does not change discontinuously at the boundaries of the areas (1) to (3). In other words, the sensor signal changes continuously at the boundaries of the areas (1) to (3).

In the present embodiment, the presence or absence of the leading end Prs can be detected by detection of an inclination K1 of the sensor signal when the leading end Prs passes by the roller 92 and an inclination K2 of the sensor signal when the leading end Prs passes by the sensor 93. In other words, with reference to FIG. 12, the leading end Prs can be detected by detection of the inclination K1 of the sensor signal when the leading end Prs moves from the area (1) to the area (2) and the inclination K2 of the sensor signal when the leading end Prs moves from the area (2) to the area (3).

In the present embodiment, the inclination of the sensor signal when the leading end Prs passes by the roller 92 is referred to as the inclination K1 as a first inclination, whereas the inclination of the sensor signal when the leading end Prs passes by the sensor 93 is referred to as the inclination K2 as a second inclination. In FIG. 12, the inclination K1 has a negative value whereas the inclination K2 has a positive value as will be described later. Alternatively, however, the inclination K1 may have a positive value whereas the inclination K2 may have a negative value, depending on the type of the sensor 93.

Referring now to FIGS. 13A to 15D, a description is given of the inclinations of the sensor signal in the signal waveform of the sensor 93 illustrated in FIG. 12.

FIGS. 13A to 13D are diagrams illustrating, along a time series, the leading end Prs moving to the position illustrated in FIG. 11B after reaching the point indicated by broken line A in FIG. 11A, which is the position of the roller 92. In other words, FIGS. 13A to 13D are diagrams illustrating the leading end Prs moving to the area (2) after reaching an end of the area (1).

As illustrated in FIGS. 13A to 13D, when the leading end Prs passes by the roller 92, the distance between the sheet roll Pr and the roller 92 gradually changes as the roller 92 rotates. The leading end Prs passes by the roller 92 as illustrated in FIGS. 13A to 13D, starting from FIG. 13A to FIG. 13D through, for example, FIGS. 13B and 13C. On the other hand, the arm 91 is pivoted as illustrated FIGS. 13A to 13D, starting from FIG. 13A to FIG. 13D through, for example, FIGS. 13B and 13C. The movement of the roller 92 and the arm 91 is schematically indicated by thick arrow in, for example, FIGS. 13B and 13C.

FIGS. 14A to 14D illustrate the movement of the sensor 93 at this time.

FIGS. 14A to 14D correspond to FIGS. 13A to 13D. FIGS. 14A to 14D and FIGS. 13A and 13D indicate the same time series. As the arm 91 moves as illustrated in FIGS. 13A to 13D, the sensor 93 gradually changes as illustrated in FIGS. 14A to 14D, starting from FIG. 14A to FIG. 14D through, for example, FIGS. 14B and 14C. For example, such a change of the sensor 93 may be expressed as a gradual decrease in the distance between the sheet roll Pr and the base portion of the sensor 93 indicated by circle in FIGS. 14A to 14D. Alternatively, such a change of the sensor 93 may be expressed as a gradual decrease in the angle of the detection portion of the sensor 93 indicated by L shape in FIGS. 14A to 14D. As the sensor 93 gradually changes as described above, the sensor signal has the inclination K1 as illustrated in FIG. 12 when the leading end Prs passes by the roller 92.

Figure 15A:
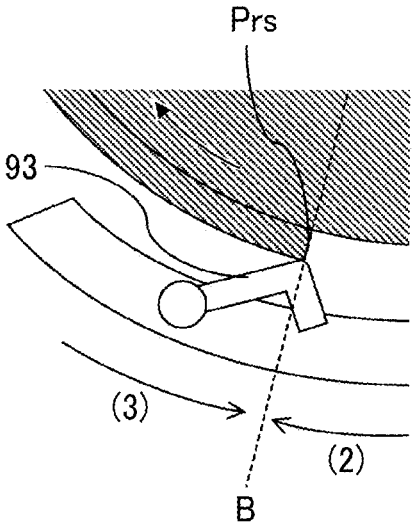
FIGS. 15A to 15D are diagrams illustrating an example of movement of the sensor along a further change in the position of the leading end of the sheet roll from the position illustrated in FIGS. 14A to 14D.

FIGS. 15A to 15D are diagrams illustrating, along a time series, the leading end Prs moving to the position illustrated in FIG. 11C after reaching the point indicated by broken line B in FIG. 11B, which is the position of the sensor 93. In other words, FIGS. 15A to 15D are diagrams illustrating the leading end Prs moving to the area (3) after reaching an end of the area (2). FIG. 15A is a diagram illustrating a state later than that of FIG. 14D.

Although the position indicated by broken line B in FIGS. 11A to 11C is slightly different from the position indicated by broken line B in FIGS. 15A to 15D, such a slight difference does not affect the result at all. FIGS. 11A to 11C illustrate, by broken line B, a straight line passing through a contact point at which the sensor 93 contacts the sheet roll Pr when the leading end Prs is located in the area (1). On the other hand, FIGS. 15A to 15D illustrate, by broken line B, a straight line passing through a contact point at which the sensor 93 contacts the sheet roll Pr when the leading end Prs is located in the area (2).

Figure 15B:
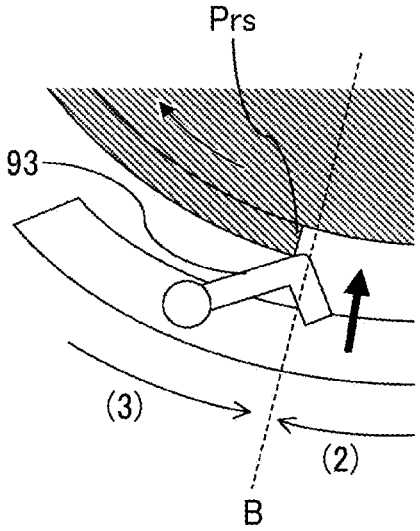
Figure 15C:
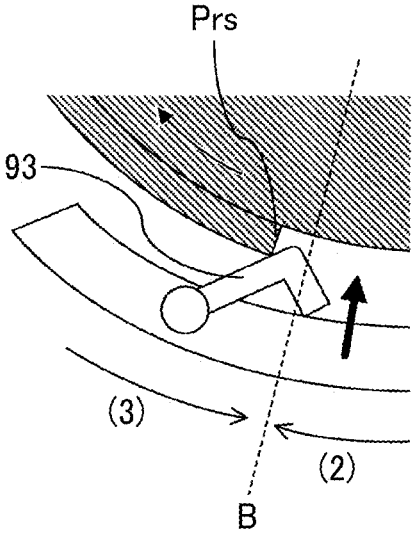
Figure 15D:
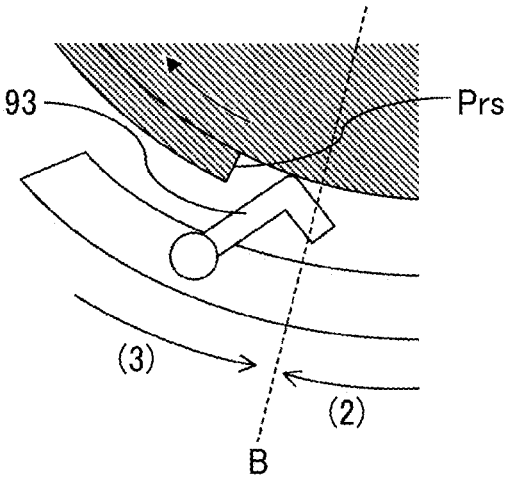

As illustrated in FIGS. 15A to 15D, when the leading end Prs passes by the sensor 93, the sensor 93 gradually changes as illustrated in FIGS. 15A to 15D, starting from FIG. 15A to FIG. 15D through, for example, FIGS. 15B and 15C. As the sensor 93 gradually changes as described above, the sensor signal has the inclination K2 as illustrated in FIG. 12 when the leading end Prs passes by the sensor 93. Since the sensor 93 in the present embodiment has a detection accuracy that allows the sensor 93 to detect the step at the leading end Prs, the sensor 93 can detect the inclinations K1 and K2.

Figure 16:
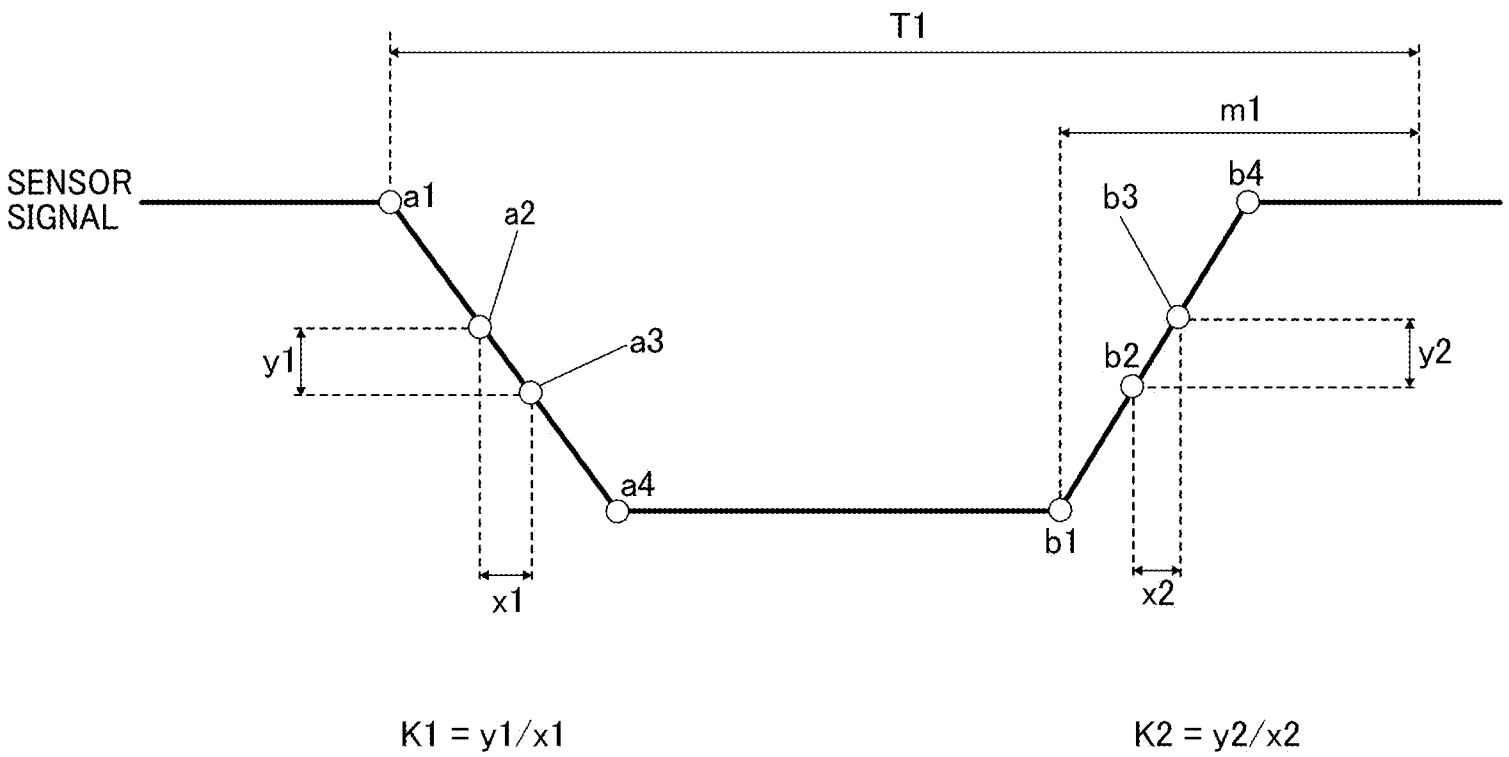
FIG. 16 is a diagram illustrating in detail the signal waveform of the sensor illustrated in FIG. 12.

Referring now to FIG. 16, a detailed description is given of the sensor signal illustrated in FIG. 12.

FIG. 16 is a diagram illustrating in detail the signal waveform of the sensor 93 illustrated in FIG. 12.

In FIG. 16, the sensor signal changes from a point a1 to a point a4 when the leading end Prs passes by the roller 92. The inclination K1 is obtained by selecting points a2 and a3 between the point a1 and the point a4. For example, in FIG. 16 in which x indicates the horizontal axis whereas y indicates the vertical axis, the signal changes by x1 horizontally and by y1 vertically between the point a2 and the point a3. In short, the inclination K1 is obtained by equation "K1=y1/x1." Although the inclination is not particularly limited, the inclination may be detected when the value of the inclination K1 is within a given range. Alternatively, a plurality of inclinations may be obtained by selecting a plurality of points and an average of the plurality of inclinations may be calculated.

In FIG. 16, the sensor signal changes from a point b1 to a point b4 when the leading end Prs passes by the sensor 93. The inclination K2 is obtained by selecting points b2 and b3 between the point b1 and the point b4. For example, in FIG. 16 in which x indicates the horizontal axis whereas y indicates the vertical axis, the signal changes by x2 horizontally and by y2 vertically between the point b2 and the point b3. In short, the inclination K2 is obtained by equation "K2=y2/x2." As described above, although the inclination is not particularly limited, the inclination may be detected when the value of the inclination K2 is within a given range. Alternatively, a plurality of inclinations may be obtained by selecting a plurality of points and an average of the plurality of inclinations may be calculated. In FIG. 16, the sign of the inclination K1 is opposite to the sign of the inclination K2.

As described above, the presence or absence of the leading end Prs can be detected by detection of the inclination K1 of the sensor signal when the leading end Prs passes by the roller 92 and the inclination K2 of the sensor signal when the leading end Prs passes by the sensor 93. Further, in the present embodiment, the detection of both the inclination K1 and the inclination K2 enhances the accuracy for detecting the presence or absence of the leading end Prs.

As illustrated in FIG. 16, it is preferable to detect, within a given period of time T1, the inclination K1 of the sensor signal when the leading end Prs passes by the roller 92 and the inclination K2 of the sensor signal when the leading end Prs passes by the sensor 93. Detection of the inclinations K1 and K2 within the period of time T1 prevents an erroneous detection caused by the uneven surface of the sheet roll Pr.

The period of time T1 may be selected as appropriate. Preferably, the period of time T1 is obtained by $$T1=L/V+m1 \text{ [s]},$$

where L (mm) represents a circumferential distance from the roller 92 to the sensor 93, V (mm/s) represents a linear velocity of the leading end Prs, and m1 (s) represents a margin time. Obtaining the period of time T1 as described above prevents the erroneous detection caused by the uneven surface of the sheet roll Pr and a failure in detecting the leading end Prs.

When the leading end Prs is not detected after one rotation of the sheet roll Pr or the spool after the start of the leading-end detecting operation, the sheet roll Pr or the spool is preferably rotated further to repeat the leading-end detecting operation. Thus, the detection accuracy is further enhanced. In this case, the number of times of execution is preferably set. Setting the number of times of execution prevents endless repetition of the leading-end detecting operation.

As represented by the above equation, the period of time T1 can be set as desired. The margin time m1 (s) is not particularly limited and may be set as appropriate, provided that the margin time m1 (s) is smaller than the period of time T1 (m1<T1). For example, the margin time m1 (s) may be set in consideration of, for example, the type of the sensor 93 or the thickness of the sheet roll Pr.

In the present embodiment, for example, the controller 110 determines whether the leading end Prs is present or absent. As will be described later, the controller 110 may detect the position of the leading end Prs in addition to the presence or absence of the leading end Prs. In this case, the position of the leading end Prs is a position in the circumferential direction of the sheet roll Pr.

In the example of detection described above, the controller 110 determines that the leading end Prs is present when the inclinations K1 and K2 are detected within the given period of time T1. Alternatively, as described below, the controller 110 may determine that the leading end Prs is present when the inclination K1 or the inclination K2 is detected at the (n+1)th rotation of the sheet roll Pr or the spool after the inclination K1 or the inclination K2 is not detected at the nth rotation of the sheet roll Pr or the spool in a plurality of rotations of the sheet roll Pr or the spool in repeated leading-end detecting operation.

Figure 17:
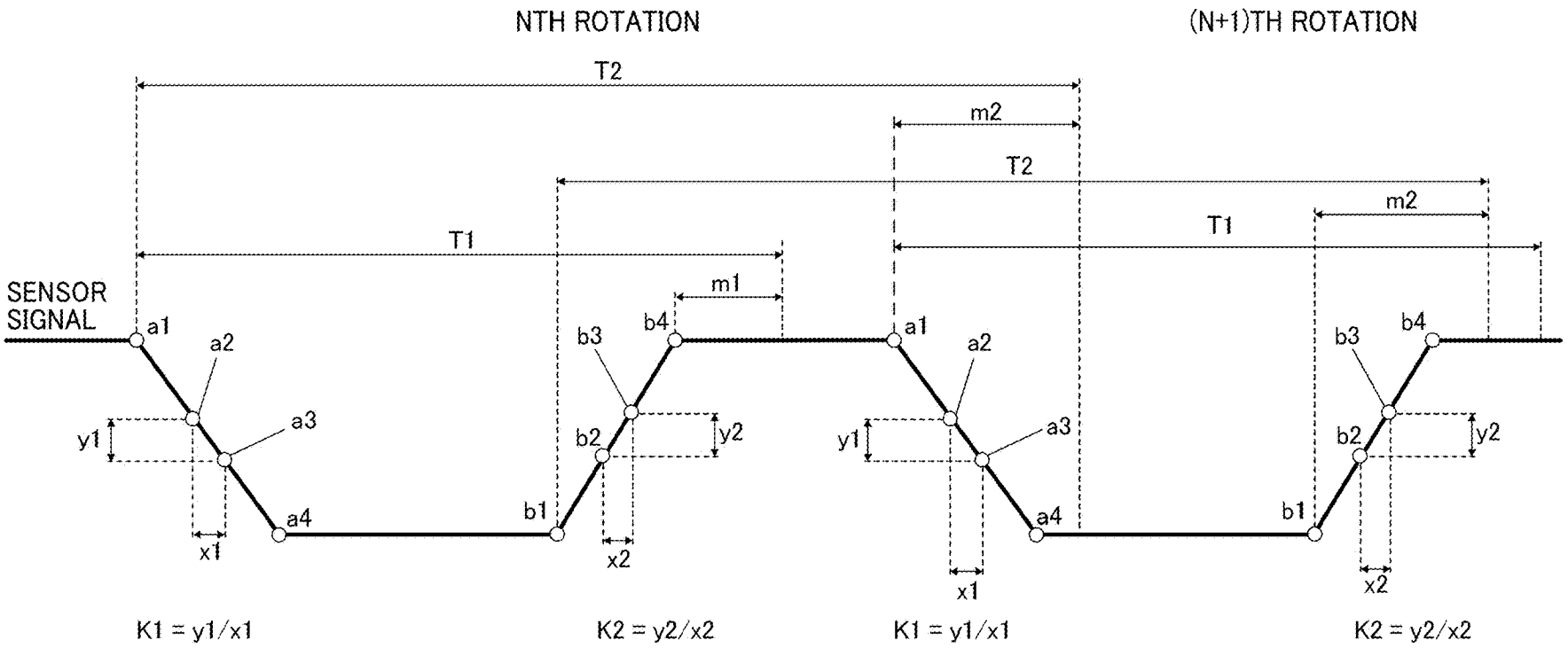
FIG. 17 is a diagram illustrating a signal waveform of a sensor in a repeated detecting operation.

Referring now to FIG. 17, the detailed description is continued of the sensor signal illustrated in FIG. 12.

FIG. 17 illustrates an example in which the sheet roll Pr or the spool is rotated a plurality of times to repeat the leading-end detecting operation. Note that FIG. 17 illustrates a signal waveform at the nth rotation of the sheet roll Pr or the spool and a signal waveform at the (n+1)th rotation of the sheet roll Pr or the spool. N is an integer of one or more. For example, N is one.

In the example of detection described above, the controller 110 determines that the leading end Prs is present when the inclinations K1 and K2 are detected within the period of time T1 at the nth rotation of the sheet roll Pr or the spool. For example, in a case where the two or more rollers 92 are disposed along a roller axis as illustrated in FIG. 7A and the leading end Prs is obliquely cut, the inclination K1 or the inclination K2 may be difficult to detect.

To reliably detect the inclinations K1 and K2, in the present embodiment, the controller 110 may determine whether the inclination K1 is detected again, within a given period of time T2, after detection of the inclinations K1 and K2. When the inclination K1 is detected again, the controller 110 may determine that the leading end Prs is present. Thus, the detection accuracy is further enhanced. The given period of time T2 (s) is obtained by adding a margin time m2 (s) to a period of time taken for the sheet roll Pr or the spool to make one rotation. When the inclination K1 is detected at the nth rotation of the sheet roll Pr or the spool, the controller 110 may determine whether the inclination K1 is detected at the next (n+1)th rotation of the sheet roll Pr or the spool.

Similarly, the controller 110 may determine whether the inclination K2 is detected again, within the given period of time T2, after detection of the inclinations K1 and K2. When the inclination K2 is detected again, the controller 110 may determine that the leading end Prs is present. Thus, the detection accuracy is further enhanced. When the inclination K1 is difficult to detect, the controller 110 preferably determines whether the inclination K2 is detected again, within the given period of time T2, after the detection of the inclination K2.

In particular, the controller 110 more preferably determines whether the inclination K1 or the inclination K2 is detected again, within the given period of time T2, after the detection of the inclinations K1 and K2 is repeated a plurality of times. In this case, the detection accuracy is further enhanced.

The examples described above refer to the operations performed in steps S21 to S25, S28, and S29 in the flow of FIG. 19 described later.

The margin time m2 (s) is not particularly limited and may be selected as appropriate, provided that the margin time m2 (s) is smaller than the given period of time T2 (m2<T2). Like the margin time m1 described above, the margin time m2 (s) may be set in consideration of, for example, the thickness of the sheet roll Pr or the type of the sensor 93.

Now, a description is given of whether the inclination K1 is detected again at the (n+1)th rotation after the inclination K1 is detected at the nth rotation of the sheet roll Pr or the spool. For example, when the inclination is detected at the nth rotation of the sheet roll Pr or the spool and the inclination is equal to or larger than a given value, the controller 110 may determine that the inclination K1 is detected. When the inclination is detected again at the (n+1)th rotation and the inclination is equal to or greater than the given value, the controller 110 may determine that the inclination K1 is detected. Note that the given value may be selected as appropriate. For example, when the absolute value of the detected inclination is equal to or greater than four, the controller 110 may determine that the inclination K1 is detected. The inclination K1 is detected again, within the given period of time T2, after the inclination K1 is detected. The same applies to the inclination K2. When the absolute value of the detected inclination is equal to or greater than a given value, the controller 110 may determine that the inclination K2 is detected. In this case, before the absolute value is determined, the sign of the inclination K2 is checked to determine that the inclination K2 is different from the inclination K1.

The controller 110 may examine the ratio of the inclinations instead of the way described above, to determine that the inclination K1 is detected again, within the given period of time T2, after the detection of the inclination K1. Note that K1 (*n*) and K1 (*n*+1) may not be exactly equal to each other, where K1 (*n*) represents the inclination K1 at the nth rotation of the sheet roll Pr or the spool and K1 (*n*+1) represents the inclination K1 at the (n+1)th rotation of the sheet roll Pr or the spool. When the ratio of K1 (*n*) to K1 (*n*+1) is within a given range, the controller 110 may determine that the inclination K1 is detected again, within the given period of time T2, after the detection of the inclination K1. For example, when K1 (*n*) is equal to or greater than K1 (*n*+1) (i.e., K1 (*n*)≥K1 (*n*+1)) and "K1 (*n*)/K1 (*n*+1)" is 1.0 or more and 1.2 or less, K1 (*n*) and K1 (*n*+1) may be equal to each other. When K1 (*n*) is less than K1 (*n*+1) (i.e., K1 (*n*)<K1 (*n*+1)) and "K1 (*n*)/K1 (*n*+1)" is 0.8 or more and less than 1.0, K1 (*n*) and K1 (*n*+1) may be equal to each other. The same applies to the inclination K2. For example, when K2 (*n*) is equal to or greater than K2 (n+1) (i.e., K2 (*n*)≥K2 (n+1)) and "K2 (*n*)/K2 (n+1)" is 1.0 or more and 1.2 or less, K2 (*n*) and K2 (n+1) may be equal to each other. When K2 (*n*) is less than K2 (n+1) (i.e., K2 (*n*)<K2 (n+1)) and "K2 (*n*)/K2 (n+1)" is 0.8 or more and less than 1.0, K2 (*n*) and K2 (n+1) may be equal to each other.

In an embodiment of the present disclosure, the controller 110 may determine whether the leading end Prs is present based on the detection of the inclination K2 alone. In this case, the inclination K2 of the sensor signal is detected when the leading end Prs passes by the sensor 93. When the inclination K2 is detected at the nth rotation of the sheet roll Pr or the spool, the controller 110 determines whether the inclination K2 is detected again at the (n+1)th rotation of the sheet roll Pr or the spool. When the inclination K2 is detected continuously during a given number of rotations of the sheet roll Pr or the spool, the controller 110 determines that the leading end Prs is present. Thus, the leading end Prs is detected even when the inclination K1 is difficult to detect. The given number of rotations of the sheet roll Pr or the spool may be selected as appropriate.

For example, in a case where the two or more rollers 92 are disposed along the roller axis as illustrated in FIG. 7A and the leading end Prs is obliquely cut, the inclination K1 may be difficult to detect. In this case, the detection accuracy is enhanced by detecting the inclination K2 alone after repeating the detection of the inclinations K1 and K2 a given number of times.

The inventor(s) have examined whether an irregularity other than the leading end Prs is erroneously detected as the leading end Prs when the controller 110 determines that the leading end Prs is present by the detection of the inclination K2 alone. The irregularity other than the leading end Prs may be erroneously detected as the leading end Prs in a case where the irregularity is sharp and the position of the irregularity coincides with the position of a sensor actuator. Such an irregularity may be formed when, for example, the sheet roll Pr is hit against a corner of an object. In a case where the irregularity is not sharp, the inclination is not detected as the inclination K2. In addition, for example, as compared with the shape of an R portion of the sensor actuator, an inclined portion of the irregularity is small. In other words, the inclination of the sensor signal is small. As a result, the irregularity is not detected as the leading end Prs. For these reasons, when the leading end Prs is determined based on the detection of the inclination K2 alone, an erroneous detection does not occur or merely occurs.

Figure 18:
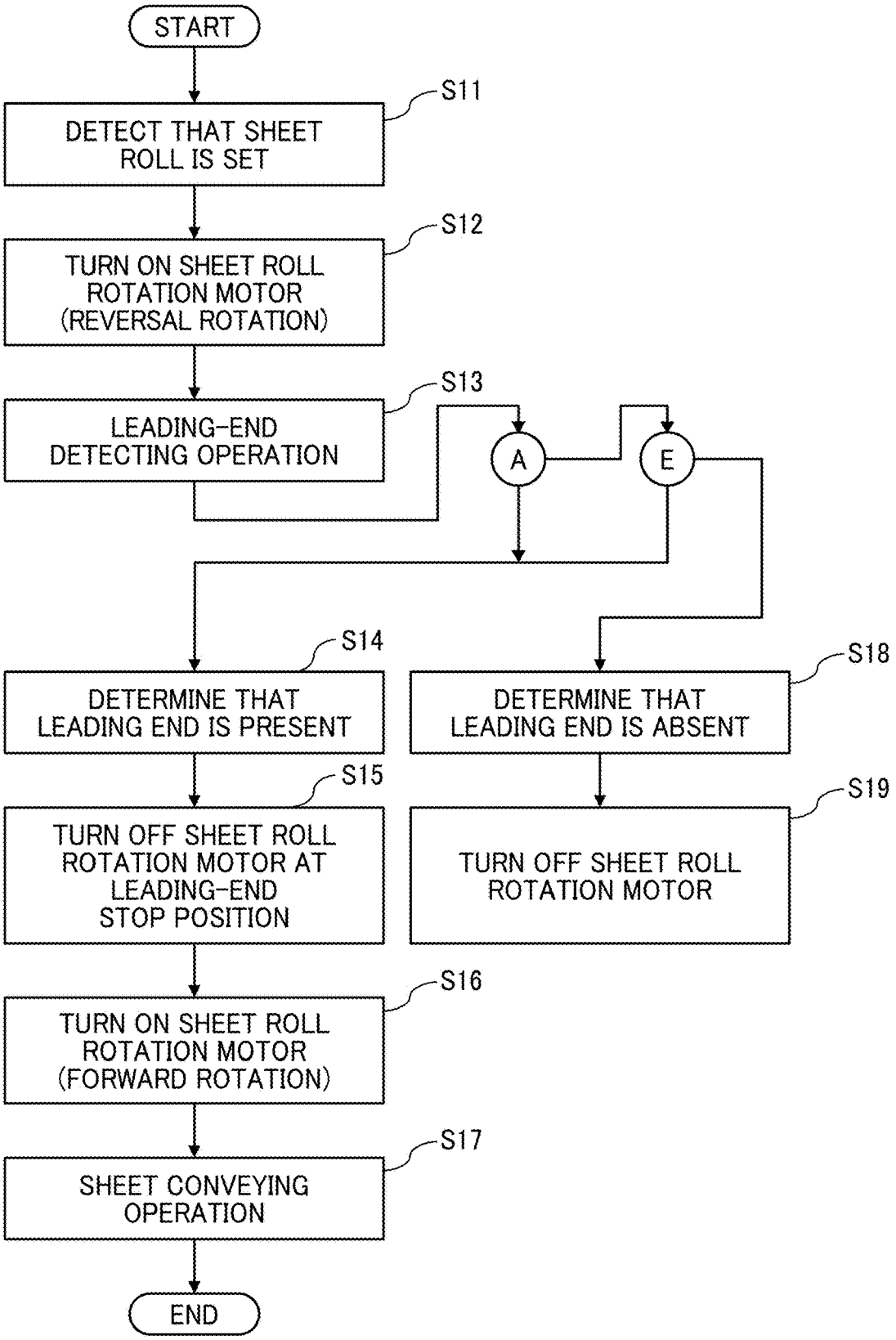
FIG. 18 is a flowchart of a process from setting a sheet roll to performing a sheet conveying operation.

Referring now to FIG. 18, a description is given of a process from when a sheet roll is set to when the sheet P is conveyed.

FIG. 18 is a flowchart of a sheet roll setting process in the sheet feeding device 90 according to an embodiment of the present disclosure.

In step S11, the controller 110 detects that the sheet roll Pr is set in the sheet feeding device 90, for example, based on the result of detection performed by the sensor 93. The controller 110 controls the motor driving circuit 120 to cause the sheet roll driver 130 to rotate the sheet roll Pr in the reverse direction. In step S12, the sheet roll rotation motor (e.g., the sheet roll driver 130) is turned on to rotate the sheet roll Pr in the reverse direction to wind the sheet P. In step S13, the sensor 93 performs the leading-end detecting operation.

The encircled A in FIG. 18 represents processing performed in the leading-end detecting operation of step S13. Specifically, a flow illustrated in FIG. 19 is followed in the leading-end detecting operation of step S13. In the following description, the flow illustrated in FIG. 19 may be referred to as a flow A. As illustrated in FIG. 18, the encircled A (flow A) is followed by the encircled E and step S14 in which the leading end Prs is detected. The encircled E represents a flow illustrated in FIG. 20. In the following description, the flow illustrated in FIG. 20 may be referred to as a flow E. As illustrated in FIG. 18, the encircled E (flow E) is followed by steps S14 and S18. In step S14, the leading end Prs is detected. In step S18, the leading end Prs is not detected.

Specifically, in step S14, the controller 110 determines that the leading end Prs is present based on the detection performed by the sensor 93. When the leading Prs is thus detected, in step S15, the controller 110 controls the motor driving circuit 120 to stop or turn off the sheet roll rotation motor at a leading-end stop position where the leading end Prs stops. In step S16, the sheet roll rotation motor is turned on to rotate the sheet roll Pr in the forward direction to feed the leading end Prs in the sheet conveying direction. In step S17, the motor driving circuit 140 rotates the conveyor 160 to convey the leading end Prs into the image forming apparatus 80.

On the other hand, in step S18, the controller 110 determines that the leading end Prs is absent, in other words, the leading end Prs is not detected. When the leading end Prs is not detected as a result of the flow E, in step S19, the sheet roll rotation motor is stopped or turned off. Thereafter, processing such as displaying a warning on a display is performed optionally.

Figure 19:
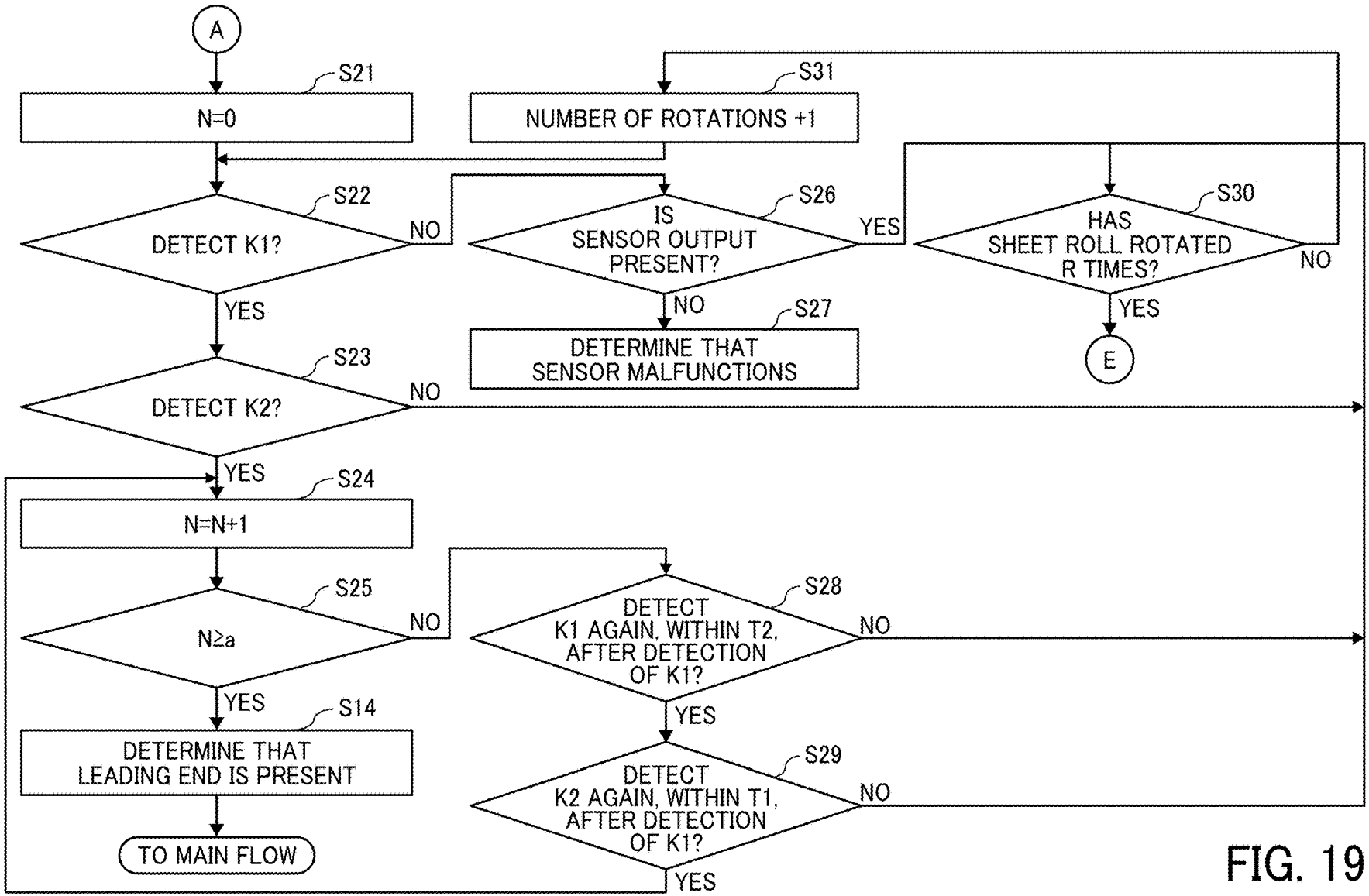
FIG. 19 is a continuation from A of the flowchart of FIG. 18.

Referring now to FIG. 19, a description is given of the flow A corresponding to the encircled A in FIG. 18.

FIG. 19 illustrates the flow A in the leading-end detecting operation in step S13.

In step S21, the number N of times of detection of the leading end Prs is set to 0.

In step S22, the controller 110 determines whether the inclination K1 is detected. When the inclination K1 is detected (YES in step S22), in step S23, the controller 110 determines whether the inclination K2 is detected within the period of time T1. When the inclination K2 is detected after the detection of the inclination K1 within the period of time T1 (YES in step S23), in step S24, the number N of times of detection of the leading end Prs is increased by one.

The controller 110 determines whether the inclination K2 is detected within the period of time T1 as described above with reference to FIG. 16, for example. The determination in step S22 may be referred to as determination as to whether a sensor displacement output (K1) is detected.

In step S25, the controller 110 determines whether the number N of times of detection of the leading end Prs is equal to or greater than a specific value "a." The specific value "a" is a value assigned to indicate the number of times of detection of the leading end Prs based on which the controller 110 determines that the leading end Prs is present. The specific value "a" is an integer equal to or greater than one. The specific value "a" is increased to enhance the reliability of the leading-end detecting operation. Note that FIG. 21 illustrates a table that presents the terms (symbols) used in the flowcharts of FIGS. 19 and 20 and the meanings of the terms (symbols).

When the number N of times of detection of the leading end Prs is equal to or greater than the specific value "a" (YES in step S25), in step S14, the controller 110 determines that the leading end Prs is detected, in other words, the controller 110 determines that the leading end Prs is present. Thus, the process proceeds to the main flow illustrated in FIG. 18. Note that FIGS. 18 and 19 illustrate common step S14 simply to facilitate understanding.

As described above, when the specific value "a" is one, the inclination K2 is detected after the inclination K1 is detected within the period of time T1 (in steps S21 to S25 of FIG. 19). For this reason, the controller 110 determines that the leading end Prs is present (in step S14 of FIG. 19).

In step S25, when the number N of times of detection of the leading end Prs is less than the specific value "a" (i.e., N<a) (NO in step S25), the leading-end detecting operation is continued as in steps S28 and S29 of FIG. 19 in the present embodiment. In step S28, the controller 110 determines whether the inclination K1 is detected again, within the period of time T2, after the detection of the inclination K1. As described above with reference to FIG. 17, the controller 110 determines whether the inclination K1 is detected again within the period of time T2 to enhance the detection accuracy.

When the inclination K1 is detected again within the period of time T2 (YES in step S28), in step S29, the controller 110 determines whether the inclination K2 is detected, within the period of time T1, after the detection of the inclination K1. When the inclination K2 is detected, within the period of time T1, after the inclination K1 is detected (YES in step S29), the process returns to step S24 in which the number N of times of detection of the leading end Prs is increased by one. In step S25, the controller 110 determines again whether the number N of times of detection of the leading end Prs is equal to or greater than the specific value "a." When the number N of times of detection of the leading end Prs is equal to or greater than the specific value "a" (YES in step S25), in step S14, the controller 110 determines that the leading end Prs is present. Thus, the process returns to the main flow illustrated in FIG. 18. The operations in steps S25, S28, and S29 further enhances the detection accuracy.

In step S22 of FIG. 19, when the inclination K1 is not detected (NO in step S22), in step S26, the controller 110 determines whether a sensor output is present. When no sensor output is present (NO in step S26), in step S27, the controller 110 determines that the sensor 93 is out of order or malfunctions.

Specifically, in step S26, for example, the controller 110 determines whether the sensor output is present for a given period of time. For example, the given period of time is preferably equal to or longer than a period of time taken for the sheet roll Pr or the spool to make one rotation. Thus, the erroneous detection is reduced.

By contrast, when the inclination K1 is not detected (NO in step S22) and the sensor output is present (YES in step S26), in step S30, the controller 110 determines the number of rotations of the sheet roll Pr. Specifically, in step S30, the controller 110 determines whether the sheet roll Pr has rotated R times. As presented in the table of FIG. 21, R represents a value assigned to indicate how many times the sheet roll Pr is rotated until the leading end Prs is detected. Although the controller 110 determines the number of rotations of the sheet roll Pr in the present embodiment, the controller 110 may determine the number of rotations of the spool in another embodiment of the present disclosure. When the sheet roll Pr has not rotated R times yet (NO in step S30), in step S31, the number of rotations is counted up. Subsequently, in step S22, the controller 110 determines again whether the inclination K1 is detected.

Although the inclination K1 is not detected in the flow from step S22 to S30 through step S26, the sensor 93 may not be out of order because the sensor output is present. Since the inclination K1 is not detected for some reasons, the sheet roll Pr is repeatedly rotated to try to detect the inclination K1. Performing such processing a plurality of times reduces omission of detection of the leading end Prs despite the presence of the leading end Prs.

Figure 20:
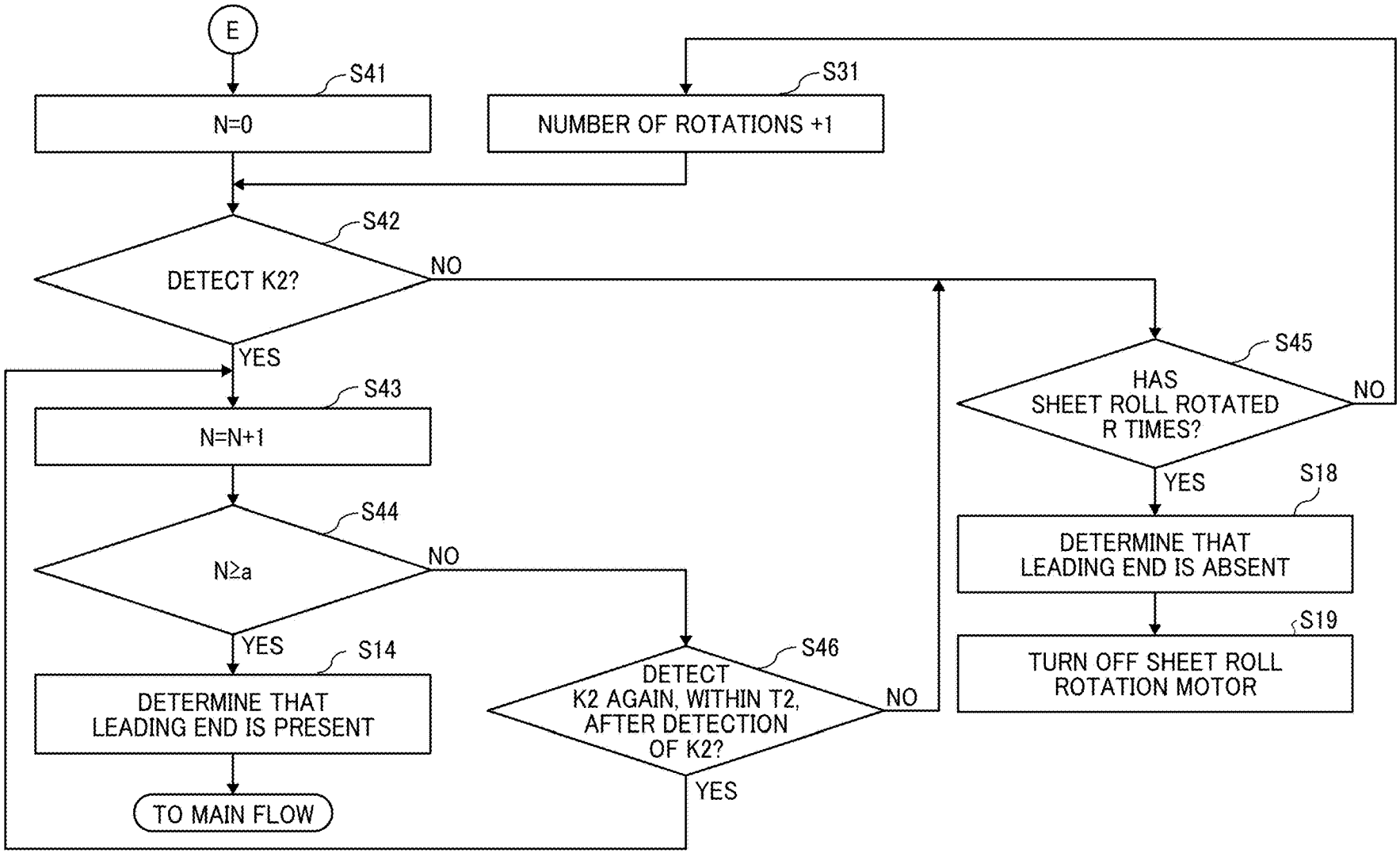
FIG. 20 is a continuation from E of the flowchart of FIG. 19.

By contrast, when the sheet roll Pr has rotated R times (YES in step S30), the process proceeds to the flow E illustrated in FIG. 20.

When the inclination K2 is not detected (No in step S23), when the inclination K1 is not detected again within the period of time T2 (NO in step S28), or when the inclination K2 is not detected again within the period of time T1 (NO in step S29), in step S30, the controller 110 determines the number of rotations of the sheet roll Pr. When the sheet roll Pr has rotated R times (YES in step S30), the process proceeds to the flow E illustrated in FIG. 20. In short, when the leading end Prs is not detected in the flow A, the process proceeds to the flow E.

FIG. 20 is a flowchart of an example of the flow E.

In step S41, the number N of times of detection of the leading end Prs is set to 0. In step S42, the controller 110 determines whether the inclination K2 is detected. The determination in step S42 may be referred to as determination as to whether a sensor displacement output (K2) is detected.

When the inclination K2 is detected (YES in step S42), in step S43, the number N of times of detection of the leading end Prs is increased by one. In step S44, the controller 110 determines whether the number N of times of detection of the leading end Prs is equal to or greater than the specific value "a." As described above, the specific value "a" is a value assigned to indicate the number of times of detection of the leading end Prs based on which the controller 110 determines that the leading end Prs is present. When the number N of times of detection of the leading end Prs is equal to or greater than the specific value "a" (YES in step S44), in step S14, the controller 110 determines that the leading end Prs is detected, in other words, the controller 110 determines that the leading end Prs is present. Thus, the process proceeds to the main flow illustrated in FIG. 18. Note that FIGS. 18 and 20 illustrate common step S14 simply to facilitate understanding.

In step S44, the specific value "a" is preferably two or more. The operation of step S46 is preferably performed at least once. In other words, the controller 110 preferably determines whether the inclination K2 is detected in a plurality of rotations of the sheet roll Pr or the spool. It is preferable, in step S44, that the controller 110 determines whether the inclination K2 is detected again at the (n+1)th rotation when the inclination K2 is detected at the nth rotation of the sheet roll Pr or the spool and that the controller 110 determines that the leading end Prs is present when the inclination K2 is detected continuously during a given number of rotations of the sheet roll Pr or the spool. In this case, the leading end Prs is detected with higher accuracy. For example, the irregularity other than the leading end Prs is prevented from being erroneously recognized as the inclination K2.

When the number N of times of detection of the leading end Prs is less than the specific value "a" (NO in step S44), in step S46, the controller 110 determines whether the inclination K2 is detected again, within the period of time T2, after the detection of the inclination K2. In other words, in step S46, the controller 110 determines whether the inclination K2 is detected again at the (n+1)th rotation of the sheet roll Pr or the spool when the inclination K2 is detected at the nth rotation of the sheet roll Pr or the spool (see FIG. 17). When the inclination K2 is detected again within the period of time T2 (YES in step S46), the process returns to step S43.

When the inclination K2 is not detected (NO in step S42), in step S45, the controller 110 determines the number of rotations of the sheet roll Pr. Specifically, in step S45, the controller 110 determines whether the sheet roll Pr has rotated R times. As described above, R represents a value assigned to indicate how many times the sheet roll Pr is rotated until the leading end Prs is detected. When the sheet roll Pr has not rotated R times yet (NO in step S45), in step S31, the number of rotations is counted up. Subsequently, in step S42, the controller 110 determines again whether the inclination K2 is detected.

By contrast, when the sheet roll Pr has rotated R times or more (YES in step S45), in step S18, the controller determines that the leading end Prs is absent. In step S19, the sheet roll rotation motor is turned off. Note that FIGS. 18 and 20 illustrate common steps S18 and S19 simply to facilitate understanding.

When the inclination K2 is not detected again within the period of time T2 (NO in step S46), in step S45, the controller 110 determines the number of rotations of the sheet roll Pr. When the sheet roll Pr has rotated R times (YES in step S45), in step S18, the controller determines that the leading end Prs is absent. In step S19, the sheet roll rotation motor is turned off.

By performing the operations of steps S22, S26, and S30, and further performing the operations of steps S42, S44, and preferably S46, the controller 110 detects the presence or absence of the leading end Prs based on the detection of the inclination K2 alone when the inclination K1 is not detected. The operation of step S46 enhances the detection accuracy.

When a spool that is not provided with a sheet roll is set in a typical sheet feeding device, the sheet feeding device may execute processing that is to be executed when a sheet roll is set, even though no sheet roll is set. In such a case, an operator has to cancel the processing first. Thus, the operator takes extra labor and time. In addition, the operator may have to stop and recover the device.

Further, the typical sheet feeding device may need an increased number of parts to detect that no sheet roll is set and may have some difficulties in enhancing the detection accuracy. For example, a reflective sensor may be used to detect whether the detected object is a sheet roll or a spool shaft, based on the difference in reflectance between the surface of the sheet roll and the surface of the spool shaft. However, such a way increases the number of parts due to the addition of the sensor, leading to an increase in cost, and may cause erroneous detection due to the influence of external light. One approach to such unfavorable situations involves enhancing the accuracy for detecting that no sheet roll is set.

In the present embodiment, the leading end Prs is automatically and accurately detected simply by setting the spool on a holder of the sheet feeding device. In the present embodiment, when detecting the leading end Prs, the controller 110 determines that the sheet roll Pr is set. Such a configuration obviates the need to provide additional components such as a reflective sensor. In other words, such a configuration allows the controller 110 to detect that the sheet roll Pr s set, without increasing the number of parts.

As will be described later, according to the present embodiment, the sheet feeding device 90 prevents the processing that is to be executed when a sheet roll is set from being executed when no sheet roll is set. Typical feeding devices may display, on a display or a control panel, a sheet feeding screen when detecting that a spool is set on a holder. In a case where the sheet roll is not set and the spool is set alone, an operator or user needs to close the sheet feeding screen because the sheet to be fed is absent. In this case, if the operator or user erroneously presses a button for starting the sheet feeding on the sheet feeding screen, the image forming apparatus continues to move until the image forming apparatus determines that the sheet feeding has failed. In addition, the operator or user has to open the cover and stop the image forming apparatus. Thereafter, the operator or user has to take actions to recover the image forming apparatus. In short, typical feeding devices or image forming apparatuses increase the time and effort of the operator or user.

According to the embodiments of the present disclosure, the sheet feeding device automatically and accurately detects that no sheet roll is set, without increasing the number of parts, and prevents the processing that is to be executed when a sheet roll is set from being executed when no sheet roll is set.

Now, a description is given of a range of rotation of the arm 91 serving as a support.

Figure 22:
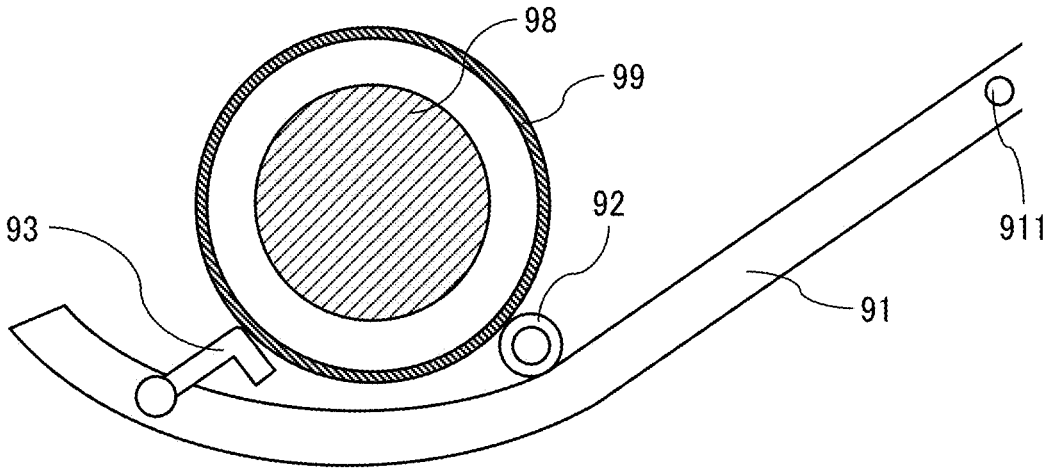
FIG. 22 is a diagram illustrating a sheet tube that is set without a sheet roll.

FIG. 22 is a diagram illustrating a sheet tube 99 of the sheet roll Pr in contact with the roller 92 and the sensor 93.

When the sheet P that is wound around the sheet tube 99 is used up and runs out, the roller 92 disposed on the arm 91 contacts the sheet tube 99 while the sensor 93 contacts the sheet tube 99 to detect the sheet tube 99. In this case, the sensor 93 detects and outputs the unevenness or irregularity on the surface of the sheet tube 99.

Figure 23:
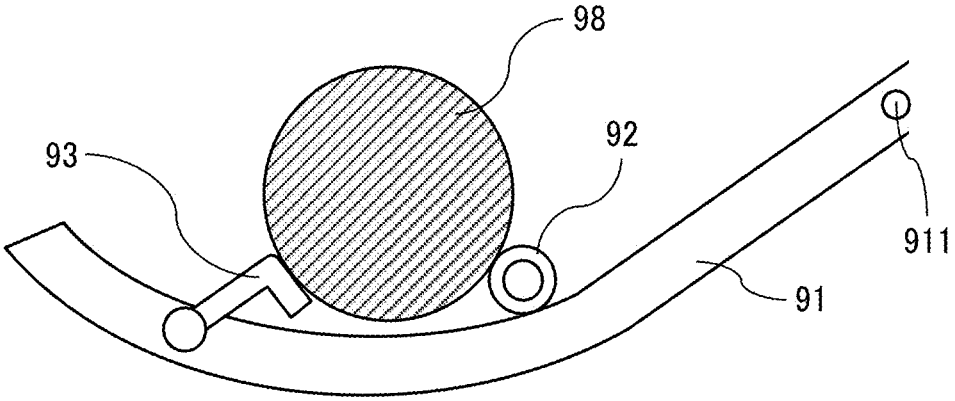
FIG. 23 is a diagram illustrating a spool that is set alone according to a comparative example.

FIG. 23 is a diagram illustrating a spool 98 that is set without the sheet roll Pr on the spool 98, according to a comparative example.

As illustrated in FIG. 23, the sensor 93 is in contact with the spool 98 to detect the spool 98. In this case, the sensor 93 detects and outputs the unevenness or irregularity on the surface of the spool 98.

Figure 24:
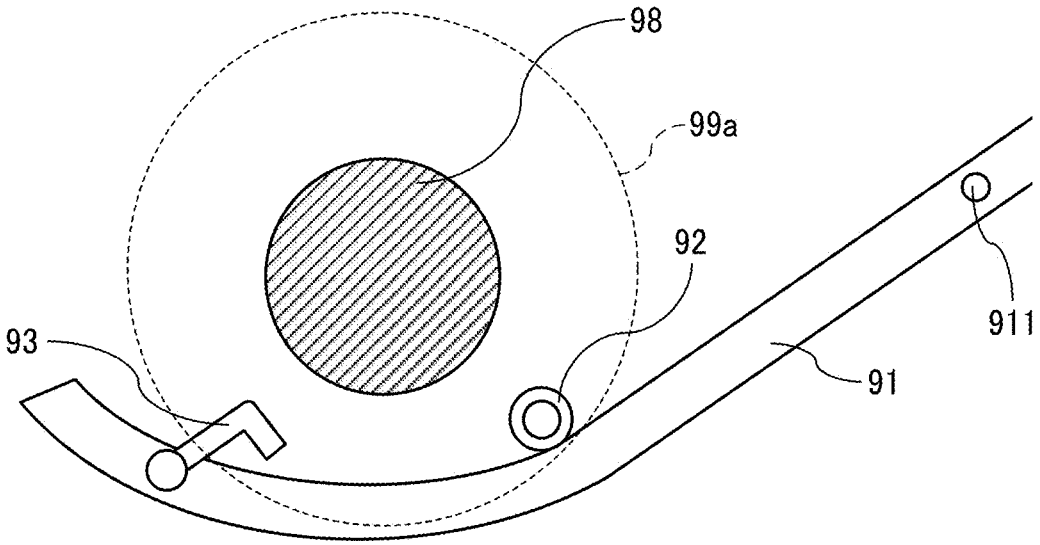
FIG. 24 is a diagram illustrating a spool that is set alone according to an embodiment of the present disclosure.

FIG. 24 is a diagram illustrating a configuration according to the present embodiment.

Specifically. FIG. 24 is a diagram illustrating a case where the spool 98 is set alone.

In FIG. 24, an outer diameter 99*a* of the sheet tube 99 is indicated by the broken line. The arm 91 is pivotable such that the roller 92 and the sensor 93 face an axial center of the spool 98. The range of rotation of the arm 91 is a range in which the sensor 93 does not contact the spool 98. For example, when the arm 91 is closest to the spool 98, the sensor 93 does not contact the spool 98. Accordingly, when the spool 98 is set alone without the sheet roll Pr, the sensor 93 does not contact anything including the spool 98. When the sensor 93 is in contact with nothing, the output of the sensor 93 remains unchanged. In other words, the output signal remains unchanged. Accordingly, it is detected with accuracy that the spool 98 is set alone without the sheet roll Pr.

Figure 25A:
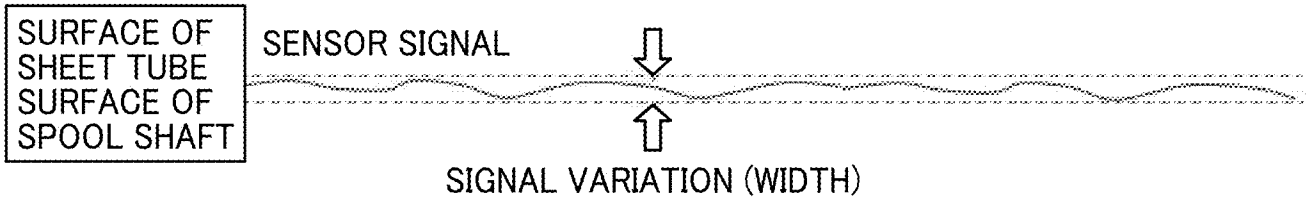
FIG. 25A is a diagram illustrating a signal waveform of a sensor that is in contact with the surface of a sheet tube or the surface of a spool.
Figure 25B:
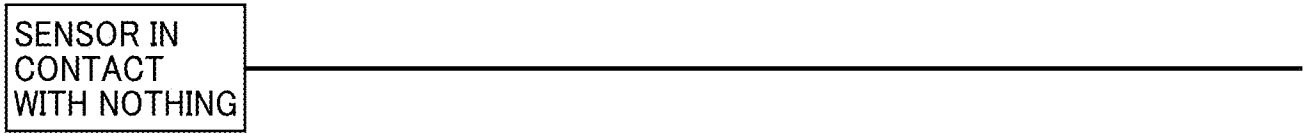
FIG. 25B is a diagram illustrating a signal waveform of the sensor that is in contact with nothing.

FIGS. 25A and 25B are diagrams each illustrating an output signal of the sensor 93.

Specifically, FIG. 25A illustrates an output signal of the sensor 93 that is in contact with the surface of the sheet tube 99 or the surface of the spool 98. Since the surface of the sheet tube 99 and the surface of the spool 98 are uneven or wavy, the signal is not constant but varies with a certain width. The width is smaller than a signal indicating the step of the sheet.

On the other hand, FIG. 25B illustrates an output signal of the sensor 93 that is in contact with nothing. Since the sensor 93 is in contact with nothing, the sensor output (i.e., the output signal of the sensor 93) remains unchanged. For example, the constant output signal of the sensor 93 that is in contact with nothing may be acquired in advance and stored in the sheet feeding device 90 or the image forming apparatus 80. The controller 110 may determine that the sensor output is constant or remains unchanged, for example, when the sensor output does not exceed a preset threshold. The threshold may be set in consideration of, for example, the type of the sensor 93.

In the automatic sheet feeding, when the spool 98 is set on a holder (e.g., the spool bearing bases 5*a* and 5*b*), a system ascertains that the spool 98 is set on the holder based on the detection performed by the spool sensor. As described above, the spool sensor detects that the spool 98 is set. The system then displays a sheet feeding screen on a display or a control panel.

The sheet feeding screen displays, for example, a screen for confirming the sheet type, a key for starting the sheet feeding, and a key for cancelling the sheet feeding. In the following description, the key for starting the sheet feeding and the key for cancelling the sheet feeding may be referred to as a sheet feeding start key and a sheet feeding cancel key, respectively. The content displayed on the sheet feeding screen may be changed as appropriate.

When the sheet feeding start key is pressed, an automatic sheet feeding operation is started. The automatic sheet feeding operation as a series of automatic sheet feeding operations includes, for example, an operation to detect the leading end Prs, an operation to convey the leading end Prs to the sheet feeder. When the automatic sheet feeding operation starts, typical image forming apparatuses may display the sheet feeding screen when a spool is placed on a holder without a sheet roll on the spool. Since the sheet feeding start key is displayed on the sheet feeding screen, an operator or user has to cancel the sheet feeding with the sheet feeding cancel key. Various situations are considered as a case where the spool is set on the holder without the sheet roll on the holder. For example, the spool may be placed on the sheet feeding device when there is no place to place the spool even though an operator or user does not intend to start the sheet feeding.

When the sheet feeding start key is pressed, the operation may be continued until the controller of the image forming apparatus determines that the automatic sheet feeding has failed. As a result, the operator or user has to open the cover and stop the image forming apparatus. In addition, after opening the cover and stopping the image forming apparatus, the operator or user has to recover the image forming apparatus. In short, typical feeding devices or image forming apparatuses increase the time and effort of the operator or user.

By contrast, in the present embodiment, the sheet feeding device 90 automatically and accurately detects the leading end Prs. Accordingly, for example, when the controller 110 determines that the leading end Prs is present, the controller 110 executes the processing that is to be executed when the sheet roll Pr is set. When the controller 110 determines that the leading end Prs is absent, the controller 110 does not execute the processing that is to be executed when the sheet roll Pr is set. As a result, the unfavorable situations as described above are prevented while the labor of the operator or user is reduced.

In the present embodiment, the controller 110 preferably detects the presence or absence of the leading end Prs after detecting that the spool 98 is disposed in the sheet feeding device 90. The controller 110 preferably displays, on a display, the sheet feeding screen that is used to feed the sheet when determining that the leading end Prs is present, and does not display, on the display, the sheet feeding screen when determining that the leading end Prs is absent, to prevent the sheet from being fed. Such processing prevents the operator or user from taking extra time and effort. In addition, such processing prevents the operator or user from pressing the sheet feeding start key when the spool 98 is set alone without the sheet roll Pr. Such processing may be executed in, for example, steps S18 and S19 in FIG. 18.

In the present embodiment, when the signal from the sensor 93 is constant within a given period of time, the controller 110 may determine that either the spool 98 is disposed alone without the sheet roll Pr or the sensor 93 is out of order. In a case where the signal from the sensor 93 is constant or remains unchanged within a certain period of time during the leading-end detecting operation in the automatic sheet feeding, the controller 110 determines that either the spool 98 is disposed alone without the sheet roll Pr or the sensor 93 is out of order. Such a determination prevents the sheet feeding screen from being displayed and therefore prevents a sheet feed operation from being instructed when the sheet roll Pr is absent.

The given period of time is preferably equal to or longer than a period of time taken for the sheet roll Pr or the spool 98 to make one rotation. Thus, the erroneous detection is reduced.

Figure 26:
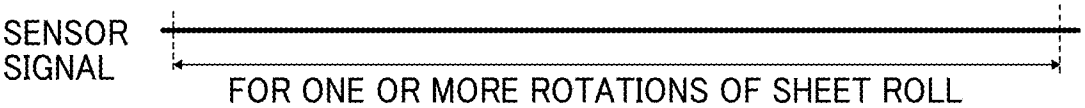
FIG. 26 is a diagram illustrating another example of signal waveform of a sensor.

FIG. 26 is a diagram illustrating a constant sensor signal.

As described above, the given period of time is equal to or longer than a period of time taken for the sheet roll Pr or the spool 98 to make one rotation. As illustrated in FIG. 26, the sensor signal is constant in the area defined by the broken line. When the signal from the sensor 93 is constant, in other words, when the signal from the sensor 93 remains unchanged, the controller 110 may determine that the spool 98 is disposed alone without the sheet roll Pr or that the sensor 93 is out of order.

When the controller 110 determines that either the spool 98 is disposed alone without the sheet roll Pr or the sensor 93 is out of order as described above, the controller 110 preferably displays, on the display, a warning indicating that either the spool 98 is disposed alone without the sheet roll Pr or the sensor 93 is out of order, instead of displaying, on the display, the sheet feeding screen that is used to feed the sheet. For example, when the operator or user is not aware that no sheet roll is set, such a warning can inform the operator or user that the sheet roll Pr is not set. In addition, such a configuration prevents a sheet feeding operation from being instructed when the sheet roll Pr is absent.

Figure 27:
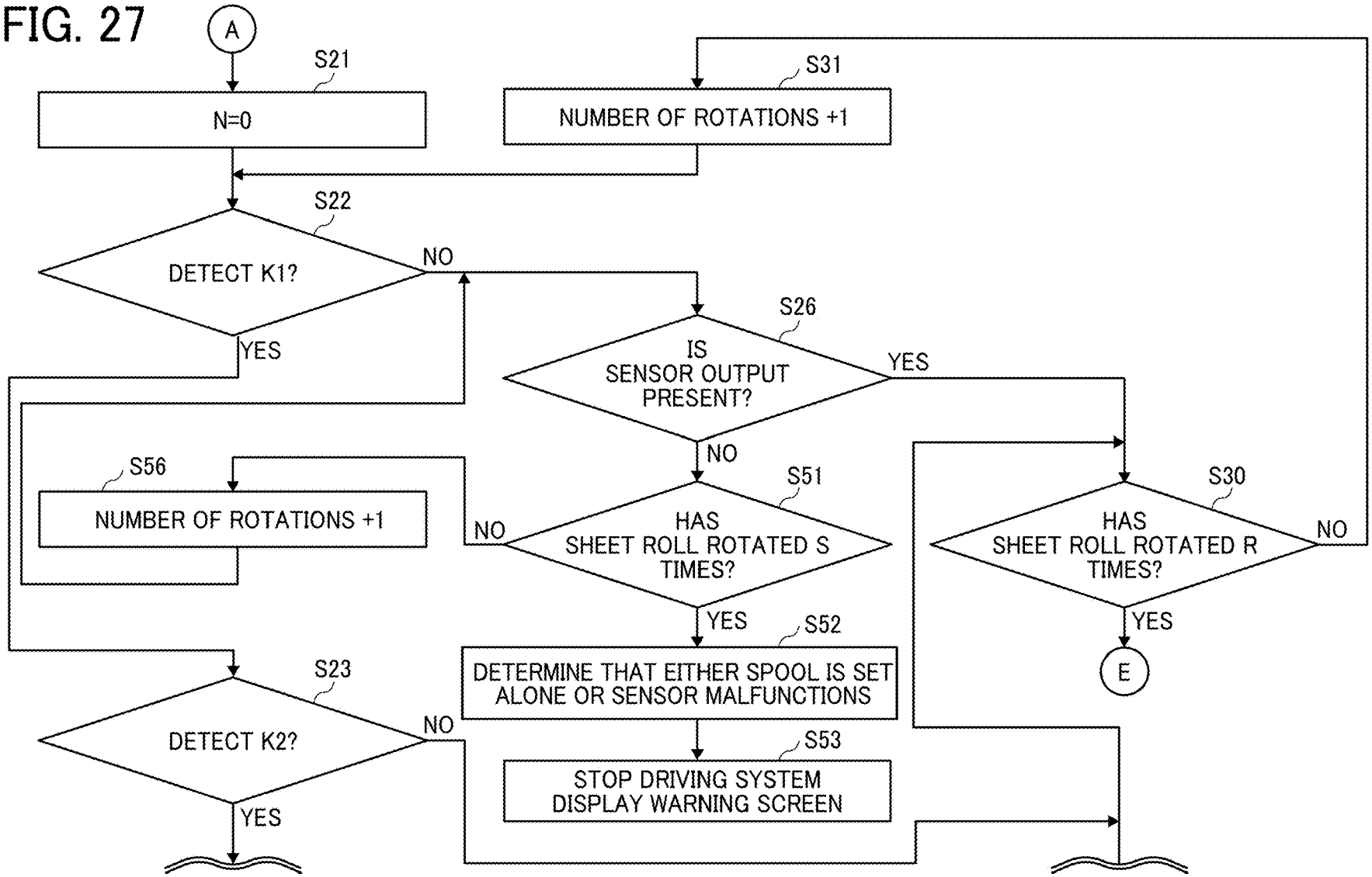
FIG. 27 is another example of continuation from A of the flowchart of FIG. 18.

Referring now to FIG. 27, a description is given of a flow in consideration of the above situation.

FIG. 27 illustrates another example of the flow A. In other words, FIG. 27 is another example of the flowchart of FIG. 19.

In FIGS. 19 and 27, like step numbers are given to like operations.

Now, a description is given of operations different from the operations illustrated in FIG. 19. As described above with reference to, for example, FIG. 19, the terms (symbols) used in the flowchart of FIG. 27 are presented in the table of FIG. 21.

Like the example illustrated in FIG. 19, in the present example, in step S22, the controller determines whether the inclination K1 is detected. When the inclination K1 is not detected (NO in step S22), in step S26, the controller 110 determines whether a sensor output is present. In the present example, when no sensor output is present (NO in step S26), in step S51, the controller 110 determines whether the sheet roll Pr has rotated S times. When the sheet roll Pr has not rotated S times yet (NO in step S5*l*), in step S56, the number of rotations is counted up. Then, the process proceeds to step S26. By contrast, when the sheet roll Pr has rotated S times (YES in step S51), in step S52, the controller 110 determines that either the spool 98 is set alone or the sensor 93 malfunctions.

The controller 110 may determine the number of rotations of the spool 98 instead of the number of rotations of the sheet roll Pr.

After the determination in step S52, in step S53, the controller 110 stops the driving system and displays a warning screen optionally. In the present example, the controller 110 displays a message indicating that either the spool 98 is set alone or the sensor 93 malfunctions. When the output of the sensor 93 is constant, either the spool 98 may be set alone without the sheet roll Pr or the sensor 93 may be out of order. For this reason, in the present embodiment, a message displayed on the warning screen is, for example, "the spool is set alone, or the sensor is out of order."

When the sensor signal is not constant (YES in step S26), in step S30, the controller 110 determines whether the sheet roll Pr has rotated R times as described above. When the sheet roll Pr has rotated R times (YES in step S30), the process proceed to the flow E as described above. The flow E and the operations after step S23 are the same as those described above, and thus redundant description thereof is omitted.

According to the flow described above, the sheet feeding screen is prevented from being displayed when the sheet feeding device 90 malfunctions or when no sheet roll is set. Such a flow obviates the need for the operator or user to take actions to address unfavorable situations caused by the sheet feeding screen being displayed and prevents the operator or user from taking time and effort. In addition, the operations illustrated in FIG. 27 are performed without additional parts for detection.

As described above, no signal is output, in other words, the sensor signal is constant, when the spool 98 is set alone without the sheet roll Pr. Similarly, no signal is output, in other words, the sensor signal is constant, when the sensor 93 is out of order. For this reason, these two cases are not distinguished from each other when no signal is output. For example, the controller 110 may determine that the sensor 93 is out of order as follows.

In the following description, the sensor 98S that detects that the spool 98 is disposed may be referred to as a spool sensor whereas the sensor 93 disposed on the arm 91 may be referred to as a leading-end sensor. For example, each of the spool bearing bases 5*a* and 5*b* may be provided with the sensor 98S serving as the spool sensor as illustrated in FIG. 1.

In the present example, the controller 110 stores in advance a pre-operation. The pre-operation includes an operation that the spool sensor detects that the spool 98 is disposed and the leading-end sensor outputs no signal during rotation of the spool 98 for a given period of time. When the spool sensor and the leading-end sensor perform an operation equivalent to the pre-operation continuously a given number of times, the controller 110 determines that the leading-end sensor is out of order. Thus, a failure of the sensor 93 may be determined. In the present embodiment, in addition to the failure of the leading-end sensor (i.e., the sensor 93), a setting failure of a connector of the sensor may be detected.

Note that the operation of each sensor in the pre-operation is stored in, for example, a memory.

Figure 28:
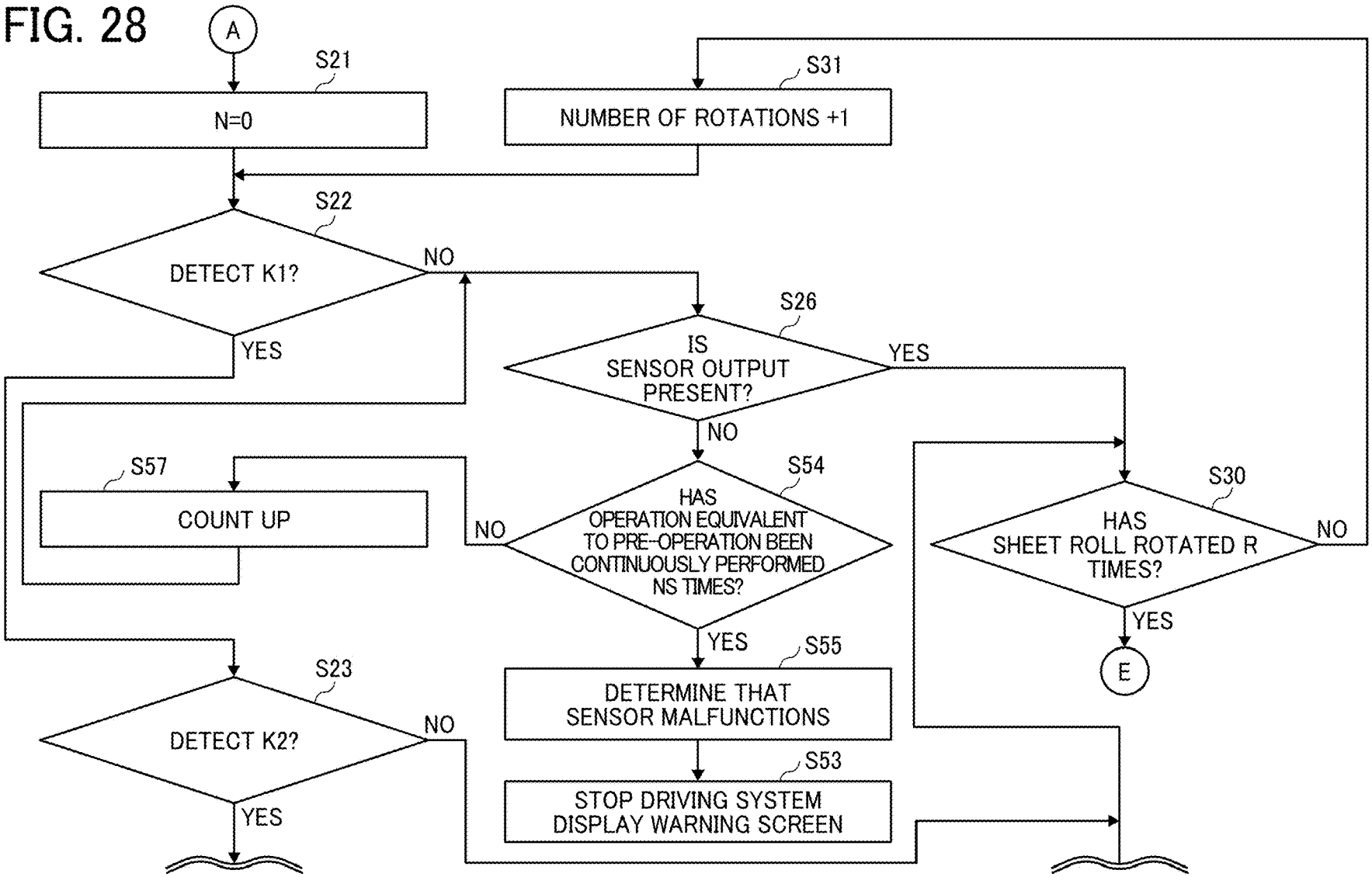
FIG. 28 is yet another example of continuation from A of FIG. 18.

FIG. 28 is a flowchart of a process to determine the failure of the sensor 93.

In FIG. 28, processing is performed in a time series different from step S51 in FIG. 27. In FIG. 27, when no output of the sensor 93 is present (NO in step S26), in step 51, the controller 110 determines whether the sheet roll Pr has rotated S times. When the sheet roll Pr has rotated S times (YES in step S51), in step S52, the controller 110 determines that either the spool 98 is set alone or the sensor 93 is out of order.

By contrast, in the flow illustrated in FIG. 28, the operations of steps S54 and S55 are performed separately from, for example, in parallel with the operations of steps S51 and S52.

Specifically, when no output of the sensor 93 is present (NO in step S26), in step S54, the controller 110 determines whether the spool sensor and the leading-end sensor have continuously performed an operation equivalent to the pre-operation a given number of times NS (i.e., NS times). When the spool sensor and the leading-end sensor have continuously performed the operation equivalent to the pre-operation the given number of times (NO in step S54), in step S57, the count is increased by one. Then, the process proceeds to step S26. When the spool sensor and the leading-end sensor have continuously performed the operation equivalent to the pre-operation NS times (YES in step S54), in step S55, the controller 110 determines that the sensor 93 malfunctions. Subsequently, in step S53, the controller 110 stops the driving system and displays the warning screen optionally. For example, a message indicating that the sensor is out of order is displayed on the warning screen. Such a message allows the operator or user to easily handle the situation.

Now, a detailed description is given of the pre-operation. As described above, the pre-operation includes an operation that the spool sensor detects that the spool 98 is set in the sheet feeding device 90 and that the leading-end sensor outputs no signal during rotation of the spool 98 for a given period of time. For example, a broken leading-end sensor is used so that the leading-end sensor outputs no signal in the pre-operation. The given period of time may be, for example, a period of time equal to or longer than a period of time taken for the spool 98 to make one rotation.

When the spool sensor and the leading-end sensor perform an operation equivalent to the pre-operation, it is stored how many times the operation has been performed. The number of times of the operation is compared with the given number of times NS. When the spool sensor and the leading-end sensor have continuously performed the operation equivalent to the pre-operation NS times, the controller 110 determines that the leading-end sensor is out of order.

The reason why the controller 110 determines in step S54 whether the spool sensor and the leading-end sensor have continuously performed the operation equivalent to the pre-operation NS times is that the controller 110 determines that the leading-end sensor is not out of order when the leading-end sensor outputs a signal at least once, in other words, when the output signal is not constant at least once. In this case, the count is cleared after the determination in step S26, which is determination of sensor output. Examples of the case where the leading-end sensor outputs a signal at least once includes a case where the sheet roll Pr is set.

Now, a description is given of an example of detection. However, the detection is not limited to the following example.

Firstly, for example, the spool 98 is set in the sheet feeding device 90 without the sheet roll Pr being set on the spool 98. At this time, the spool sensor outputs a signal. Thereafter, the spool 98 is rotated for a given period of time. However, the leading-end sensor outputs no signal or the signal is constant. Since such an operation is regarded as an operation equivalent to the pre-operation, the count is increased by one. In this case, the operation of step S51 in FIG. 27 may be performed in parallel, to display, on the warning screen, a message indicating that either the spool is set alone or the sensor is out of order.

Secondly, the spool 98 thus set firstly is set again. As a result, the spool sensor outputs a signal. Thereafter, the spool 98 is rotated for a given period of time. However, the leading-end sensor outputs no signal or the signal is constant. Since such an operation is regarded as an operation equivalent to the pre-operation, the count is increased by one.

When the number of times NS is two, the determination in step S54 is YES. Then, the controller 110 determines that the sensor malfunctions and displays a warning indicating the malfunction of the sensor. Thus, the malfunction of the sensor may be detected.

In the present example, the controller 110 determines whether the spool sensor outputs a signal when detecting that the sheet roll Pr is set in step S11 of FIG. 18.

The count is cleared, for example, when the spool 98 is set firstly without the sheet roll Pr being set on the spool 98, resulting in an increase in the count, and the spool 98 is set secondly with the sheet roll Pr being set on the spool 98, resulting in detection of an output from the leading-end sensor.

According to one or more aspects of the present disclosure, a sheet feeding device is provided that automatically and accurately detects that no sheet roll is set, without increasing the number of parts, and that prevents the processing that is to be executed when a sheet roll is set from being executed when no sheet roll is set.

The above-described embodiments are illustrative and do not limit the present invention. Thus, numerous additional modifications and variations are possible in light of the above teachings. For example, elements and/or features of different illustrative embodiments may be combined with each other and/or substituted for each other within the scope of the present invention.

Any one of the above-described operations may be performed in various other ways, for example, in an order different from the one described above.

The functionality of the elements disclosed herein may be implemented using circuitry or processing circuitry which includes general purpose processors, special purpose processors, integrated circuits, application specific integrated circuits (ASICs), digital signal processors (DSPs), field programmable gate arrays (FPGAs), conventional circuitry and/or combinations thereof which are configured or programmed to perform the disclosed functionality. Processors are considered processing circuitry or circuitry as they include transistors and other circuitry therein. In the disclosure, the circuitry, units, or means are hardware that carry out or are programmed to perform the recited functionality. The hardware may be any hardware disclosed herein or otherwise known which is programmed or configured to carry out the recited functionality. When the hardware is a processor which may be considered a type of circuitry, the circuitry, means, or units are a combination of hardware and software, the software being used to configure the hardware and/or processor.

The invention claimed is:

1. A sheet feeding device configured to feed a sheet from a sheet roll, the sheet feeding device comprising:

a sensor configured to detect a step at a leading end of the sheet roll;

a roller disposed at a position different from a position of the sensor in a circumferential direction of the sheet roll;

a support supporting the sensor and the roller to bring the sensor and the roller into contact with a surface of the sheet roll;

circuitry configured to acquire a sensor signal from the sensor; and a spool insertable through a sheet tube of the sheet roll to rotate the sheet roll in conjunction with rotation of the spool, wherein the support is pivotable within a range in which the sensor does not contact the spool, and the circuitry is configured to detect a first inclination of the sensor signal when the leading end of the sheet roll passes by the roller and detect a second inclination of the sensor signal when the leading end of the sheet roll passes by the sensor, to determine whether the leading end of the sheet roll is present.

2. The sheet feeding device according to claim 1, wherein the circuitry is configured to determine that the leading end of the sheet roll is present when detecting the first inclination and the second inclination within a period of time.

3. The sheet feeding device according to claim 1, wherein the circuitry is further configured to:

determine, when detecting the first inclination at an nth rotation of the sheet roll or the spool, whether the first inclination is detected again at an (n+1)th rotation of the sheet roll or the spool; and determine that the leading end of the sheet roll is present when continuously detecting the first inclination during a number of rotations of the sheet roll or the spool, where n is an integer of one or more.

4. The sheet feeding device according to claim 1, wherein the circuitry is further configured to:

determine, when detecting the second inclination at an nth rotation of the sheet roll or the spool, whether the second inclination is detected again at an (n+1)th rotation of the sheet roll or the spool; and determine that the leading end of the sheet roll is present when continuously detecting the second inclination during a number of rotations of the sheet roll or the spool, where n is an integer of one or more.

5. The sheet feeding device according to claim 1, wherein the circuitry is configured to determine that the spool is disposed alone without the sheet roll or the sensor is out of order, in response to the sensor signal from the sensor being constant within a period of time.

6. The sheet feeding device according to claim 5, wherein the period of time is equal to or longer than a rotation time period for the sheet roll or the spool to make one rotation.

7. The sheet feeding device according to claim 5, wherein the circuitry is further configured to display, on a display, a warning indicating that the spool is disposed alone without the sheet roll or the sensor is out of order when the circuitry determines that the spool is disposed alone without the sheet roll or the sensor is out of order.

8. The sheet feeding device according to claim 1, further comprising: a spool sensor configured to detect that the spool is disposed, wherein the sensor disposed on the support is a leading-end sensor, and the circuitry is further configured to store in advance a pre-operation including that the spool sensor detects that the spool is disposed and the leading-end sensor outputs no signal during rotation of the spool for a period of time, and determine that leading-end sensor is out of order when the spool sensor and the leading-end sensor have continuously performed an operation equivalent to the pre-operation a number of times.

9. The sheet feeding device according to claim 1, wherein the circuitry further is configured to:

determine that the spool is disposed in the sheet feeding device;

determine presence or absence of the leading end of the sheet roll after detecting that the spool is disposed; and display, on a display, a sheet feeding screen used to feed the sheet when determining that the leading end of the sheet roll is present and not display, on the display, the sheet feeding screen when determining that the leading end of the sheet roll is absent.

10. The sheet feeding device according to claim 1, wherein the support is pressed toward the spool.

11. An image forming apparatus comprising the sheet feeding device according to claim 1.

12. A sheet feeding device configured to feed a sheet from a sheet roll, the sheet feeding device comprising:

a sensor configured to detect a step at a leading end of the sheet roll;

a roller disposed at a position different from a position of the sensor in a circumferential direction of the sheet roll;

a support supporting the sensor and the roller to bring the sensor and the roller into contact with a surface of the sheet roll;

circuitry configured to acquire a sensor signal from the sensor; and a spool insertable through a sheet tube of the sheet roll to rotate the sheet roll in conjunction with rotation of the spool, wherein the support being pivotable within a range in which the sensor does not contact the spool, and the circuitry is further configured to:

detect an inclination of the sensor signal when the leading end of the sheet roll passes by the sensor;

determine, when detecting the inclination at an nth rotation of the sheet roll or the spool, whether the inclination is detected again at an (n+1)th rotation of the sheet roll or the spool, where n is an integer of one or more; and determine that the leading end of the sheet roll is present when continuously detecting the inclination for a number of rotations of the sheet roll or the spool.

* * * * *